US006795033B2

(12) United States Patent
Matz et al.

(10) Patent No.: US 6,795,033 B2
(45) Date of Patent: Sep. 21, 2004

(54) ANTENNA ALIGNMENT DEVICES

(75) Inventors: William R. Matz, Atlanta, GA (US); Timothy H. Weaver, Alpharetta, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/364,099

(22) Filed: Feb. 11, 2003

(65) Prior Publication Data

US 2003/0122720 A1 Jul. 3, 2003

Related U.S. Application Data

(63) Continuation of application No. 09/750,974, filed on Dec. 29, 2000.

(51) Int. Cl.[7] ..... H01Q 3/00
(52) U.S. Cl. ..... 343/760; 343/757; 343/894
(58) Field of Search ..... 343/757, 760, 343/878, 880, 881, 882, 894; 33/333, 352; 342/359

(56) References Cited

U.S. PATENT DOCUMENTS

| | | | | |
|---|---|---|---|---|
| 110,434 A | | 12/1870 | Clarke | |
| 780,947 A | | 1/1905 | Grabe | |
| 1,303,249 A | | 5/1919 | Brown | |
| 1,522,751 A | | 1/1925 | Sechler | |
| 1,935,246 A | | 11/1933 | Kirsch | |
| 2,463,176 A | | 3/1949 | Hogrefe | |
| 2,575,917 A | | 11/1951 | Johnson | |
| 2,611,566 A | | 9/1952 | Landis | |
| 2,667,317 A | | 1/1954 | Trebules | |
| 2,754,156 A | | 7/1956 | Elderkin | |
| 3,910,561 A | | 10/1975 | Fornells | |
| 3,941,340 A | | 3/1976 | Rankins | |
| 4,095,230 A | | 6/1978 | Salmond et al. | |
| 4,126,865 A | | 11/1978 | Longhurst et al. | |
| 4,258,568 A | * | 3/1981 | Boetes et al. | 73/170.11 |
| 4,495,706 A | | 1/1985 | Kaminski | |
| 4,626,864 A | | 12/1986 | Micklethwaite | |
| 4,691,207 A | | 9/1987 | Timineri | |
| 4,726,259 A | | 2/1988 | Idler | |
| 4,833,932 A | | 5/1989 | Rogers | |
| 4,990,924 A | | 2/1991 | McMullen et al. | |
| 5,065,969 A | | 11/1991 | McLean | |
| 5,088,672 A | | 2/1992 | Neuendorf et al. | |
| 5,138,651 A | * | 8/1992 | Sudo | 455/462 |

(List continued on next page.)

FOREIGN PATENT DOCUMENTS

| | | |
|---|---|---|
| EP | 1 014 481 A1 | 6/2000 |
| WO | 00/24083 A1 | 4/2000 |

OTHER PUBLICATIONS

U.S. patent application Ser. No. 10/014,284, Matz et al.
U.S. patent application Ser. No. 10/014,285, Matz et al.

(List continued on next page.)

*Primary Examiner*—Tho Phan
(74) *Attorney, Agent, or Firm*—Kirkpatrick & Lockhart LLP

(57) ABSTRACT

An alignment device for aligning an antenna with a satellite. In one embodiment, the device includes a digital compass to provide an azimuth reading of the antenna when the device is removably affixed to the rear surface of the antenna reflector. In another embodiment, the device includes a first digital level that provides an elevation reading of the antenna when the device is affixed to the rear surface of the antenna reflector. Another embodiment includes first and second digital levels that cooperate to emit a skew signal that is indicative of the skew orientation of the antenna when the device is affixed to the antenna. In yet another embodiment, a speaker is provided adjacent to the antenna to receive a series of tones transmitted by a transmitter that is placed adjacent to a television that is attached to a set top a box that is attached to the antenna.

6 Claims, 16 Drawing Sheets

U.S. PATENT DOCUMENTS

| | | | | | |
|---|---|---|---|---|---|
| 5,276,972 | A | | 1/1994 | Staney | |
| 5,351,060 | A | | 9/1994 | Bayne | |
| 5,376,941 | A | | 12/1994 | Fukazawa et al. | |
| 5,469,182 | A | | 11/1995 | Chaffee | |
| 5,473,335 | A | | 12/1995 | Tines | |
| 5,561,433 | A | * | 10/1996 | Chaney et al. | 342/359 |
| 5,621,418 | A | | 4/1997 | Maloney | |
| 5,646,638 | A | | 7/1997 | Winegard et al. | |
| 5,647,134 | A | | 7/1997 | Chou | |
| 5,657,031 | A | | 8/1997 | Anderson et al. | |
| 5,664,752 | A | | 9/1997 | Matthiessen et al. | |
| 5,734,356 | A | | 3/1998 | Chang | |
| 5,760,739 | A | | 6/1998 | Pauli | |
| 5,764,186 | A | * | 6/1998 | Yoo | 342/359 |
| 5,829,121 | A | | 11/1998 | Shoemaker et al. | |
| 5,870,059 | A | * | 2/1999 | Reynolds | 343/760 |
| 5,884,199 | A | | 3/1999 | Maki | |
| 5,894,674 | A | | 4/1999 | Feldman | |
| 5,903,237 | A | | 5/1999 | Crosby et al. | |
| 5,915,020 | A | | 6/1999 | Tilford et al. | |
| 5,920,291 | A | | 7/1999 | Bosley | |
| 5,933,123 | A | | 8/1999 | Kaul | |
| 5,945,945 | A | * | 8/1999 | Wagner et al. | 342/359 |
| D413,603 | S | | 9/1999 | Inoue | |
| 5,977,922 | A | | 11/1999 | Hemmingsen, II | |
| 5,992,809 | A | | 11/1999 | Sweere et al. | |
| 6,008,769 | A | | 12/1999 | Palmiter et al. | |
| 6,023,247 | A | | 2/2000 | Rodeffer | |
| 6,031,508 | A | | 2/2000 | Ishizuka et al. | |
| 6,037,913 | A | | 3/2000 | Johnson | |
| 6,208,314 | B1 | | 3/2001 | Bourquin | |
| 6,216,266 | B1 | | 4/2001 | Eastman et al. | |
| 6,262,687 | B1 | | 7/2001 | Bai et al. | |
| 6,285,338 | B1 | | 9/2001 | Bai et al. | |
| 6,331,839 | B1 | | 12/2001 | Grenell | |
| D453,151 | S | | 1/2002 | Weaver | |
| 6,337,658 | B1 | | 1/2002 | Tong et al. | |
| D453,330 | S | | 2/2002 | Weaver | |
| 6,480,161 | B2 | | 11/2002 | Watson | |
| 6,484,987 | B2 | | 11/2002 | Weaver | |
| 6,486,851 | B2 | | 11/2002 | Weaver | |
| 6,507,325 | B2 | | 1/2003 | Matz et al. | |
| 6,559,806 | B1 | | 5/2003 | Watson | |
| 2002/0083573 | A1 | | 7/2002 | Matz et al. | |
| 2002/0083574 | A1 | | 7/2002 | Matz et al. | |
| 2002/0084941 | A1 | | 7/2002 | Matz et al. | |
| 2002/0084946 | A1 | | 7/2002 | Matz et al. | |

OTHER PUBLICATIONS

U.S. patent application Ser. No. 09/467,574, McDonald.
U.S. patent application Ser. No. 10/008,424, Saunders et al.
U.S. patent application Ser. No. 10/302,023, Matz et al.
U.S. patent application Ser. No. 10/350,655, Watson.

* cited by examiner

ANTENNA ALIGNMENT DEVICES

CROSS-REFERENCE TO RELATED APPLICATIONS

This application is a continuation of U.S. patent application Ser. No. 09/750,974, Filed Dec. 29, 2000.

FEDERALLY SPONSORED RESEARCH

Not applicable.

BACKGROUND OF THE INVENTION

FIELD OF THE INVENTION

The subject invention relates to alignment devices and, more particularly, to devices for aligning an antenna with a satellite.

DESCRIPTION OF THE INVENTION BACKGROUND

The advent of the television can be traced as far back to the end of the nineteenth century and beginning of the twentieth century. However, it wasn't until 1923 and 1924, when Vladimir Kosma Zworykin invented the iconoscope, a device that permitted pictures to be electronically broken down into hundreds of thousands of components for transmission, and the kinescope, a television signal receiver, did the concept of television become a reality. Zworykin continued to improve those early inventions and television was reportedly first showcased to the world at the 1939 World's Fair in New York, where regular broadcasting began.

Over the years, many improvements to televisions and devices and methods for transmitting and receiving television signals have been made. In the early days of television, signals were transmitted over terrestrial networks and received through the use of antennas. Signal strength and quality, however, were often dependent upon the geography of the land between the transmitting antenna and the receiving antenna. Although such transmission methods are still in use today, the use of satellites to transmit television signals is becoming more prevalent. Because satellite transmitted signals are not hampered by hills, trees, mountains, etc., such signals typically offer the viewer more viewing options and improved picture quality. Thus, many companies have found offering satellite television services to be very profitable and, therefore, it is anticipated that more and more satellites will be placed in orbit in the years to come. As additional satellites are added, more precise antenna/satellite alignment methods and apparatuses will be required.

Modern digital satellite communication systems typically employ a ground-based transmitter that beams an uplink signal to a satellite positioned in geosynchronous orbit. The satellite relays the signal back to ground-based receivers. Such systems permit the household or business subscribing to the system to receive audio, data and video signals directly from the satellite by means of a relatively small directional receiver antenna. Such antennas are commonly affixed to the roof or wall of the subscriber's residence or are mounted to a tree or mast located in the subscriber's yard. A typical antenna constructed to received satellite signals comprises a dish-shaped reflector that has a support arm protruding outward from the front surface of the reflector. The support arm supports a low noise block amplifier with an integrated feed "LNBF". The reflector collects and focuses the satellite signal onto the LNBF which is connected, via cable, to the subscriber's television.

To obtain an optimum signal, the antenna must be installed such that the centerline axis of the reflector, also known as the "bore site" or "pointing axis", is accurately aligned with the satellite. To align an antenna with a particular satellite, the installer must be provided with accurate positioning information for that particular satellite. For example, the installer must know the proper azimuth and elevation settings for the antenna. The azimuth setting is the compass direction that the antenna should be pointed relative to magnetic north. The elevation setting is the angle between the Earth and the satellite above the horizon. Many companies provide installers with alignment information that is specific to the geographical area in which the antenna is to be installed. Also, as the satellite orbits the earth, it may be so oriented such that it sends a signal that is somewhat skewed. To obtain an optimum signal, the antenna must also be adjustable to compensate for a skewed satellite orientation.

The ability to quickly and accurately align the centerline axis of antenna with a satellite is somewhat dependent upon the type of mounting arrangement employed to support the antenna. Prior antenna mounting arrangements typically comprise a mounting bracket that is directly affixed to the rear surface of the reflector. The mounting bracket is then attached to a vertically oriented mast that is buried in the earth, mounted to a tree, or mounted to a portion of the subscriber's residence or place of business. The mast is installed such that it is plumb (i.e., relatively perpendicular to the horizon). Thereafter, the installer must orient the antenna to the proper azimuth and elevation. These adjustments are typically made at the mounting bracket.

One method that has been employed in the past for indicating when the antenna has been positioned at a proper azimuth orientation is the use of a compass that is manually supported by the installer under the antenna's support arm. When using this approach however, the installer often has difficulty elevating the reflector to the proper elevation so that the antenna will be properly aligned and then retaining the antenna in that position while the appropriate bolts and screws have been tightened. The device disclosed in U.S. Pat. No. 5,977,922 purports to solve that problem by affixing a device to the support arm that includes a compass and an inclinometer. In this device, the support arm can move slightly relative to the reflector and any such movement or misalignment can contribute to pointing error. Furthermore, devices that are affixed to the support arm are not as easily visible to the installer during the pointing process. In addition, there are many different types and shapes of support arms which can require several different adapters to be available to the installer. It will also be understood that the use of intermediate adapters could contribute pointing error if they do not interface properly with the support arm.

Another method that has been used in the past to align the antenna with a satellite involves the use of a "set top" box that is placed on or adjacent to the television to which the antenna is attached. A cable is connected between the set top box and the antenna. The installer initially points the antenna in the general direction of the satellite, then fine-tunes the alignment by using a signal strength and quality meter displayed on the television screen by the set top box. The antenna is adjusted until the onscreen meter indicates that signal strength and quality have been maximized. In addition to the onscreen display meter, many set top boxes emit a repeating tone. As the quality of the signal improves, the frequency of the tones increases. Because the antenna is located outside of the building in which the television is located, such installation method typically requires two individuals to properly align the antenna. One installer positions the antenna while the other installer monitors the onscreen meter and the emitted tones. One individual can also employ this method, but that person typically must make multiple trips between the antenna and the television until the antenna is properly positioned. Thus, such alignment methods are costly and time consuming.

In an effort to improve upon this shortcoming, some satellite antennas have been provided with a light emitting diode ("LED") that operates from feedback signals fed to the antenna by the set top box through the link cable. The LED flashes to inform the installer that the antenna has been properly positioned. It has been noted, however, that the user is often unable to discern small changes in the flash rate of the LED as antenna is positioned. Thus, such approach may result in antenna being positioned in an orientation that results in less than optimum signal quality. Also, this approach only works when the antenna is relative close to its correct position. It cannot be effectively used to initially position the antenna. U.S. Pat. No. 5,903,237 discloses a microprocessor-operated antenna pointing aid that purports to solve the problems associated with using an LED indicator to properly orient the antenna.

Such prior antenna mounting devices and methods do not offer a relatively high amount of alignment precision. Furthermore, they typically require two or more installers to complete the installation and alignment procedures. As additional satellites are sent into space, the precision at which an antenna is aligned with a particular satellite becomes more important to ensure that the antenna is receiving the proper satellite signal and that the quality of that signal has been optimized. It is also desirable to have an antenna alignment device that can be effectively used by one installer.

There is a further need for an antenna alignment device that can be quickly and accurately attached to an antenna for providing an indication of the antenna's elevation, azimuth and skew orientations.

There is yet another need for an antenna alignment device that can be used in connection with a conventional set top box by an individual installer to optimize the satellite-transmitted signal received by the antenna.

There is still another need for a method of installing and aligning a satellite reflector antenna that can be quickly and efficiently accomplished by one installer.

SUMMARY OF THE INVENTION

In accordance with one form of the present invention, there is provided a compass that is removably attachable to a rear portion of an antenna reflector. The compass is so oriented relative to the centerline of the antenna reflector when it is affixed thereto such that it serves to display the azimuth reading for the centerline of the reflector. The compass may be digital or analog and be supported in a housing that is removably attachable to the rear portion of the antenna reflector. In one embodiment, the housing is removably attachable to the rear portion of the antenna reflector by a mounting member. The mounting member may be provided with a first pin that is sized to be received within a first hole provided in the rear portion of the reflector. The mounting member may further have a second pin that is sized to be received within a second hole in the rear portion of the reflector. In addition, the mounting member may have a movable pin assembly supported therein that includes a third pin that is sized to be received within a third hole in the rear portion of the reflector. The three pins serve to removably attach the mounting member to the rear portion of surface of the reflector.

In another embodiment, a level is removably attachable to a rear portion of the antenna reflector and is so oriented relative to the centerline axis of the reflector such that the level displays an elevation reading for the centerline of the reflector. The level may be digital or analog and be supported in a housing that is removably attachable to the rear portion of the antenna reflector. In one embodiment, the housing is removably attachable to the rear portion of the antenna reflector by a mounting member. The mounting member may be provided with a first pin that is sized to be received within a first hole provided in the rear portion of the reflector. The mounting member may further have a second pin that is sized to be received within a second hole in the rear portion of the reflector. In addition, the mounting member may have a movable pin assembly supported therein that includes a third pin that is sized to be received within a third hole in the rear portion of the reflector. The three pins serve to removably attach the mounting member to the rear portion of surface of the reflector.

Another embodiment of the present invention includes first and second digital levels that are removably attachable to the rear portion of an antenna reflector and are so oriented relative to each other and the centerline of the reflector such that they cooperate to generate a skew reading for the antenna's centerline axis. The first and second digital levels may be supported in a housing that is removably attachable to the rear portion of the antenna reflector. In one embodiment, the housing is removably attachable to the rear portion of the antenna reflector by a mounting member. The mounting member may be provided with a first pin that is sized to be received within a first hole provided in the rear portion of the reflector. The mounting member may further have a second pin that is sized to be received within a second hole in the rear portion of the reflector. In addition, the mounting member may have a movable pin assembly supported therein that includes a third pin that is sized to be received within a third hole in the rear portion of the reflector. The three pins serve to removably attach the mounting member to the rear portion of surface of the reflector.

One embodiment of the present invention includes a receiver and speaker that are removably attachable to a portion of an antenna reflector that is electronically connected to a set top box. The set top box is electrically coupled to a television and causes a series of tones to be emitted from the television speaker that is indicative of the antenna's alignment with a satellite. This embodiment further includes a microphone and transmitter that can be placed in the vicinity of the television speaker to transmit the emitted tones to the speaker attached to the satellite reflector. The receiver and speaker may be supported in a housing that is removably attachable to a rear portion of the satellite reflector. In one embodiment, the housing is removably attachable to the rear portion of the antenna reflector by a mounting member. The mounting member may be provided with a first pin that is sized to be received within a first hole provided in the rear portion of the reflector. The mounting member may further have a second pin that is sized to be received within a second hole in the rear portion of the reflector. In addition, the mounting member may have a movable pin assembly supported therein that includes a third pin that is sized to be received within a third hole in the rear portion of the reflector. The three pins serve to removably attach the mounting member to the rear portion of surface of the reflector.

In yet another embodiment of the present invention, a digital compass, and first and second digital levels, and a receiver and speaker are supported by a housing that is removably attachable to a portion of the antenna reflector. The housing may be removably attachable to a rear portion of the antenna reflector by a mounting member constructed in the above-described manner.

In still another embodiment of the present invention, an analog compass and an analog level may be supported in a housing that is removably attachable to the rear surface of an antenna reflector.

It is a feature of the present invention to provide apparatuses that may be removably attached to an antenna reflector and that quickly and accurately display readings that are indicative to the antenna's azimuth, elevation and/or skew positions.

Accordingly, the present invention provides solutions to the shortcomings of prior apparatuses and methods for orienting antennas for receiving satellite signals. Those of ordinary skill in the art will readily appreciate, however, that these and other details, features and advantages will become further apparent as the following detailed description of the embodiments proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
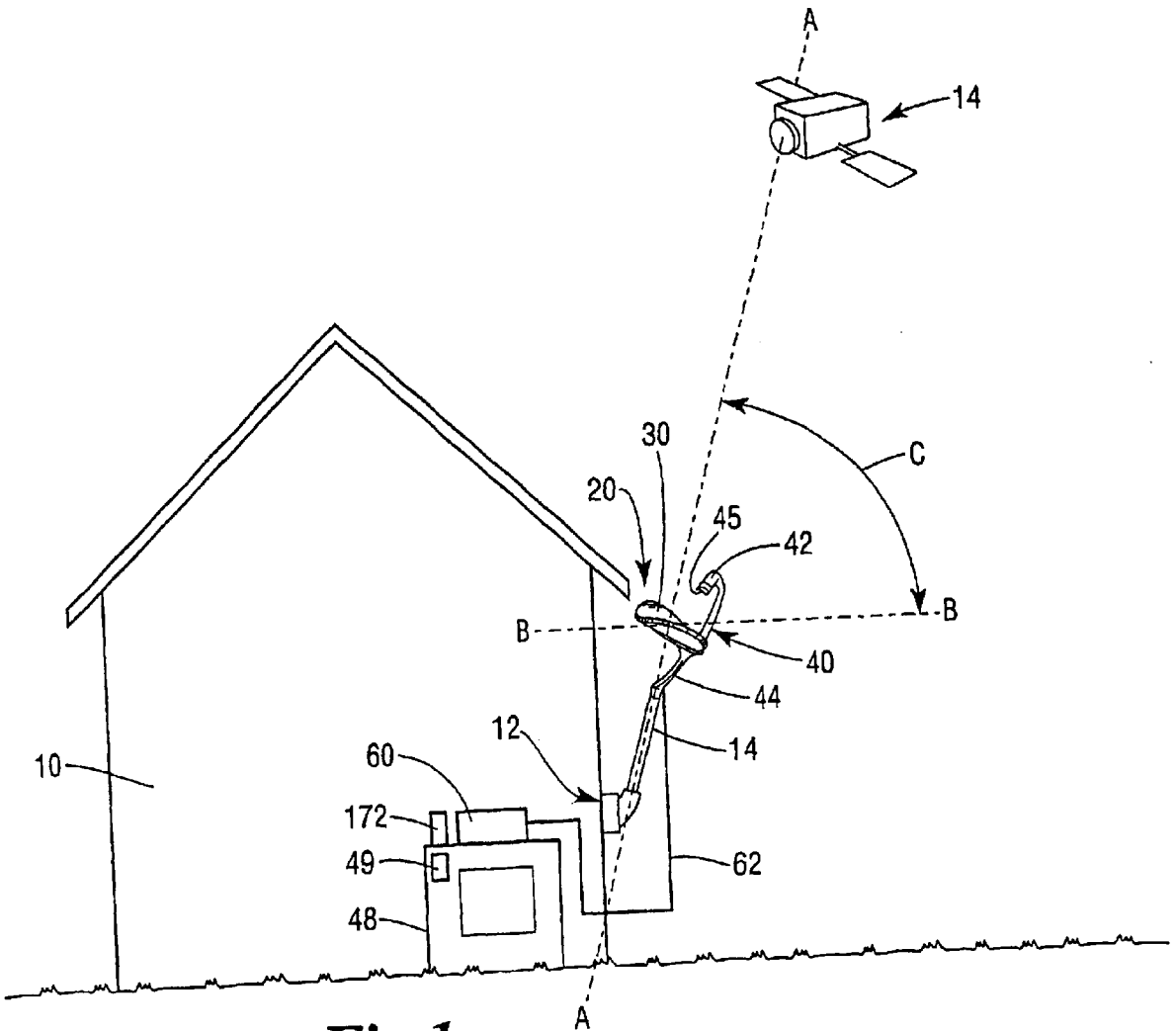
FIG. 1 is a graphical representation of an antenna attached to a building and aligned to receive a signal from a satellite.
Figure 3:
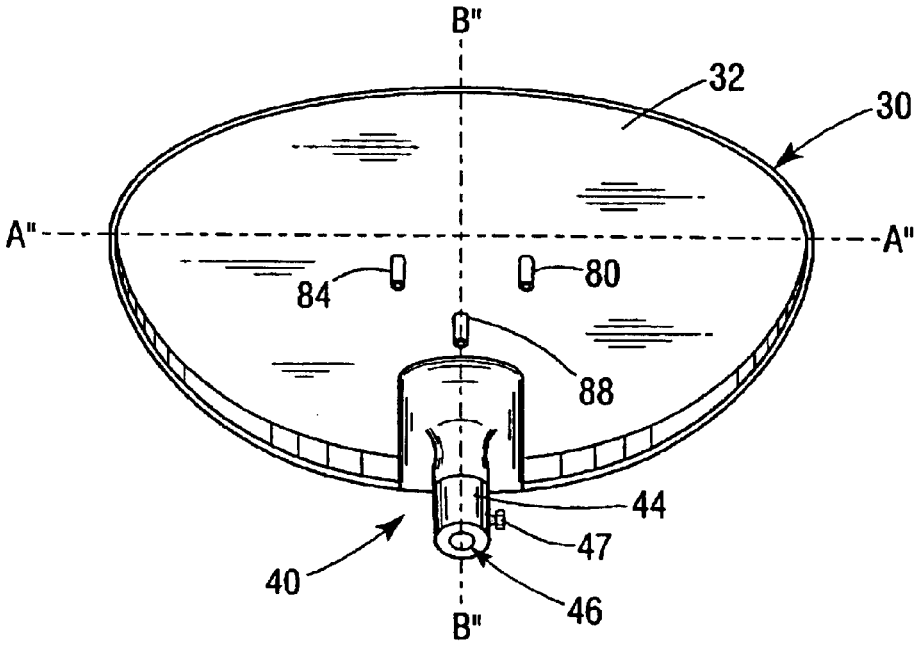
FIG. 3 is a rear view of the antenna depicted in FIG. 2.

Referring now to the drawings for the purposes of illustrating embodiments of the invention only and not for the purposes of limiting the same, FIG. 1 illustrates an antenna 20 that is attached to the wall of a residence or other building 10 by a mounting bracket 12. The antenna 20 is oriented to receive audio and video data signals from a satellite 14 in geosynchronous orbit around the earth. The antenna 20 includes parabolic reflector 30 and an arm assembly 40 that includes a forwardly extending portion 42 that supports a feed/LNBF assembly 45 for collecting focused signals from the reflector 30. Such feed/LNBF assemblies are known in the art and, therefore, the manufacture and operation of feed/LNBF assembly 45 will not be discussed herein. The antenna 20 has a centerline generally designated as A—A and is connected to a mounting bracket 12 by means of a rearwardly extending portion 44 of the support arm 44. A socket 46 is provided in the rearwardly extending portion 44 for receiving an antenna mounting mast 14 therein. See FIG. 3. The mounting mast 14 is affixed to a mounting bracket 12 that is attached to a wall of the building 10. As can be seen in FIG. 1, in this antenna embodiment, the centerline axis A—A is coaxially aligned with the centerline of the mounting mast 14. Such arrangement permits the antenna 20 to be easily adjusted for satellite skew by rotating the antenna about the mast 14 until the desired skew orientation is achieved.

The antenna 20 is attached to a satellite broadcast receiver ("set top box") 60 by coaxial cable 62. The set top box 60 is attached to a television monitor 48. Such set top boxes are known in the art and comprise an integrated receiver decoder for decoding the received broadcast signals from the antenna 20. During operation, the feed/LNBF assembly 45 converts the focused signals from the satellite 14 to an electrical current that is amplified and down converted in frequency. The amplified and down-converted signals are then conveyed via cable 62 to the set top box 60. The set top box 60 tunes the output signal to a carrier signal within a predetermined frequency range. A tuner/demodulator within the set top box 60 decodes the signal carrier into a digital data stream selected signal. Also a video/audio decoder is provided within the set top box 60 to decode the encrypted video signal. A conventional user interface on the television screen is employed to assist the installer of the antenna 20 during the final alignment and "pointing" of the antenna 20.

Figure 1A:
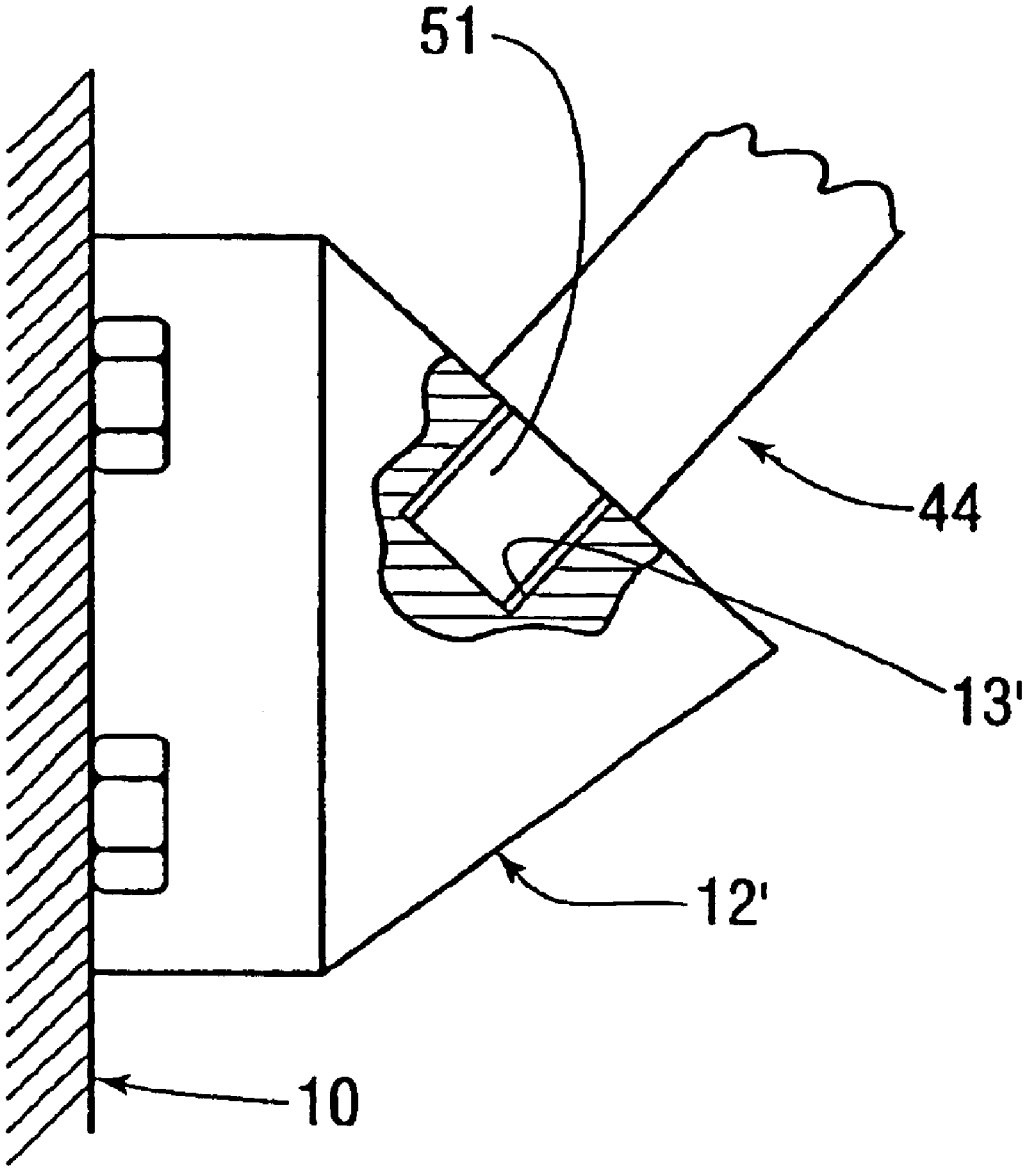
FIG. 1A is a partial view of an alternate antenna mounting member employed to support the support arm of an antenna.

In this embodiment, the mounting bracket 12 is attached to the wall of the building 10 or is affixed to a freestanding mast (not shown). The mounting bracket 12 has a mast 14 protruding therefrom that is sized to be received in a socket 46 in the mounting portion of the arm. As indicated above, the mounting bracket 12 may comprise the apparatus disclosed in co-pending U.S. patent application Ser. No. 09/751,460, entitled "Mounting Bracket", the disclosure of which is herein incorporated by reference. In another alternative mounting arrangement, the rearwardly extending portion of the support arm 44 may have a protrusion 51 formed thereon or attached thereto that is sized to be received and retained within a mounting bracket 12' that has a socket 13' formed therein. See FIG. 1A. As the present Detailed Description proceeds, however, those of ordinary skill in the art will readily appreciate that the various embodiments of the antenna pointing devices of the present invention may be used with a variety of other antennas that are supported by various other types of mounting brackets without departing from the spirit and scope of the present invention. Thus, the various embodiments of the present invention should not be limited to use in connection with the specific antenna arrangements and mounting fixtures disclosed herein.

Figure 2:
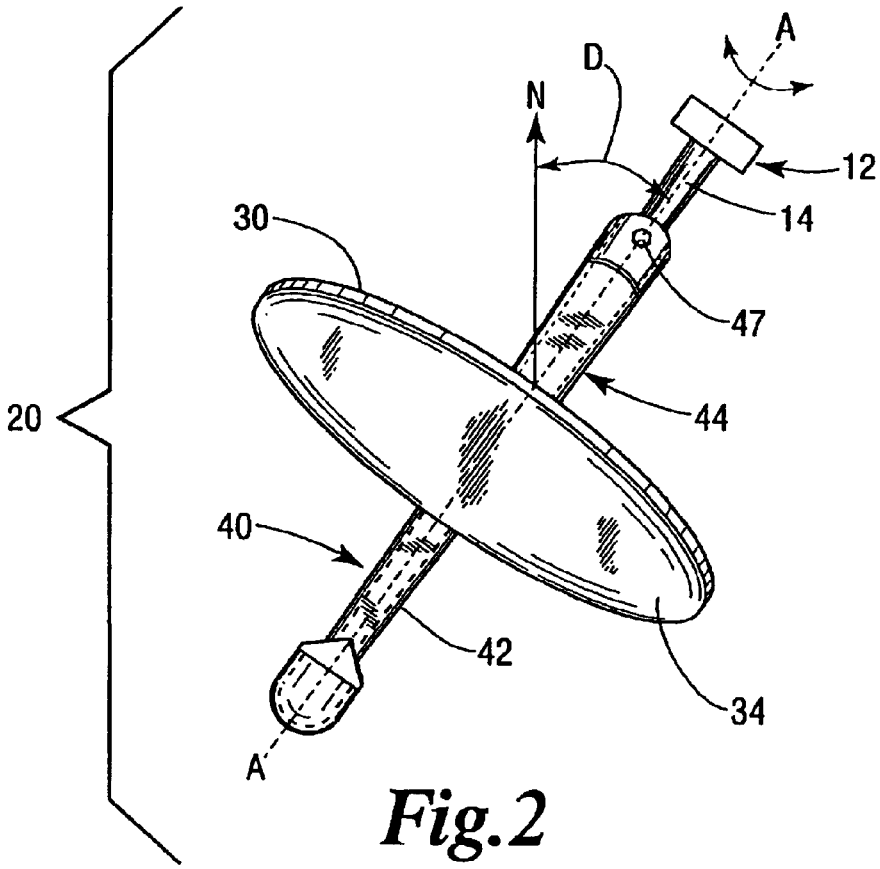
FIG. 2 is a plan view of an antenna attached to a mounting bracket.

Antenna 20 must be properly positioned to receive the television signals transmitted by the satellite 14 to provide optimal image and audible responses. This positioning process involves accurately aligning the antenna's centerline axis A—A, with the satellite's output signal. "Elevation", "azimuth" and "skew" adjustments are commonly required to accomplish this task. As shown in FIG. 1, elevation refers to the angle between the centerline axis A—A of the antenna relative to the horizon (represented by line B—B), generally designated as angle "C". In the antenna embodiment depicted in FIGS. 1 and 2, the elevation is adjusted by virtue of an elevation adjustment mechanism on the mounting bracket 12. In one mounting bracket embodiment disclosed in the above-mentioned patent application, the elevation is adjusted by loosening two elevation locking bolts and turning an elevation adjustment screw until the desired elevation has been achieved. The elevation locking bolts are then tightened to lock the bracket in position. As shown in FIG. 2, "azimuth" refers to the angle of axis A—A relative to the direction of true north in a horizontal plane. That angle is generally designated as angle "D" in FIG. 2. "Skew" refers to the angle of rotation about the centerline A—A.

Figure 3A:
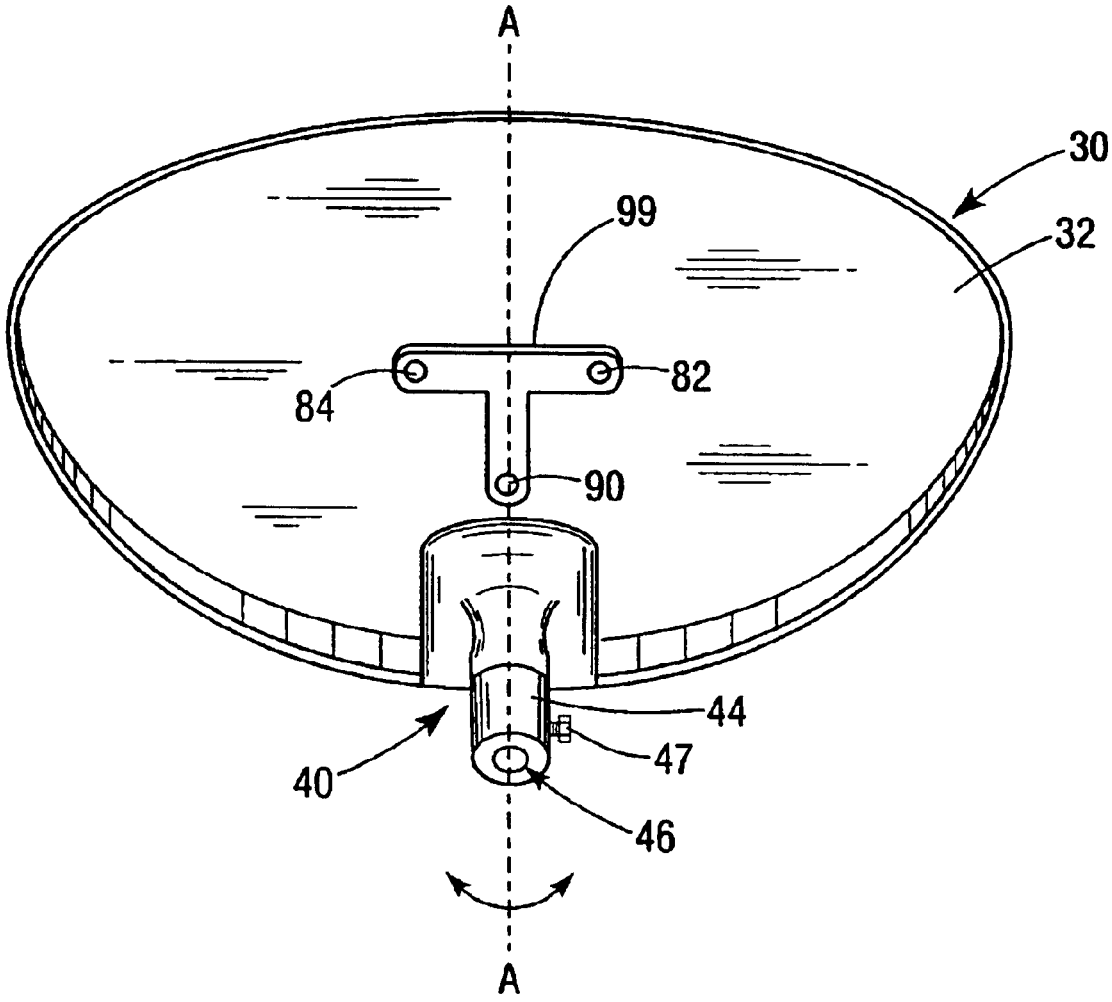
FIG. 3A is a rear view of an antenna employing another mounting configuration that can be employed with an embodiment of the antenna alignment device of the present invention.
Figure 4:
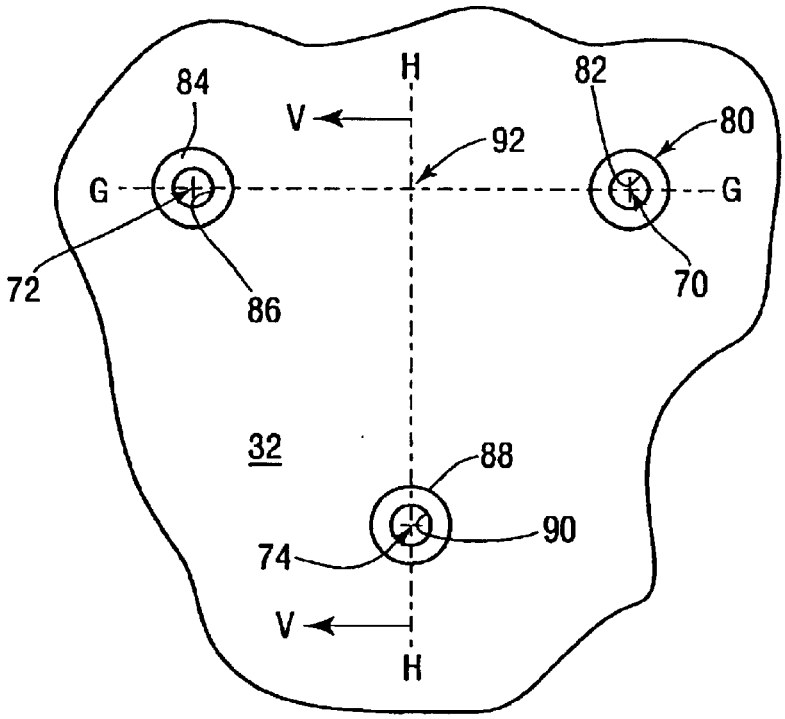
FIG. 4 is a partial view of the rear surface of the antenna depicted in FIGS. 2 and 3 illustrating three points that define a plane that is perpendicular to the centerline axis of the antenna.
Figure 5:
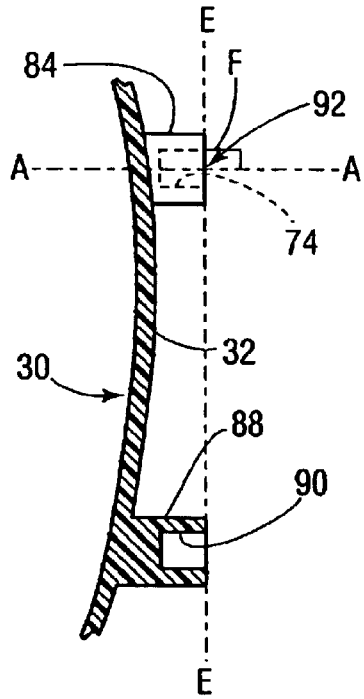
FIG. 5 is a partial cross-sectional view of the antenna of FIG. 4 taken along line V—V in FIG. 4.
Figure 4A:
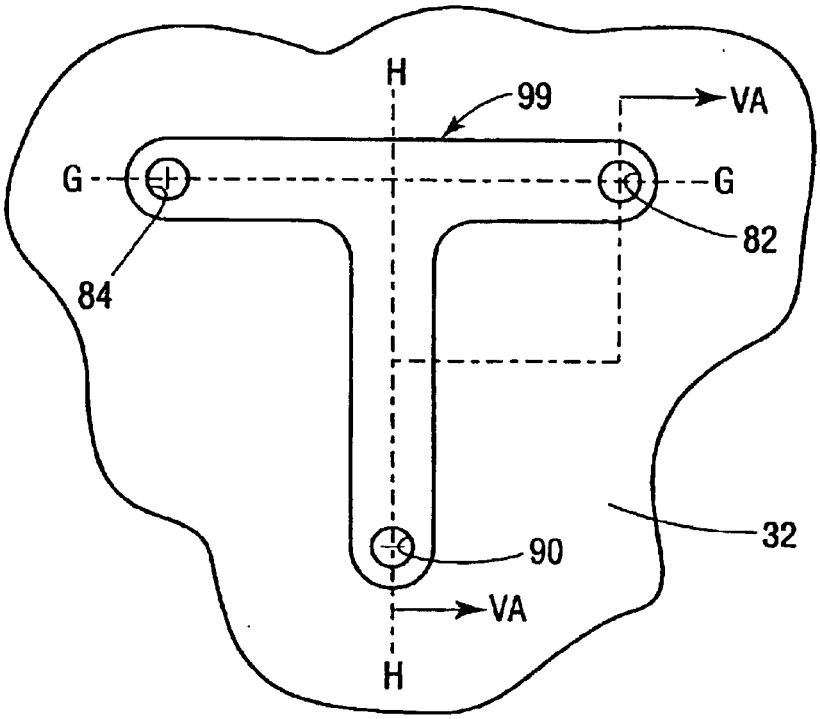
FIG. 4A is a partial view of the antenna of FIG. 3A.
Figure 5A:
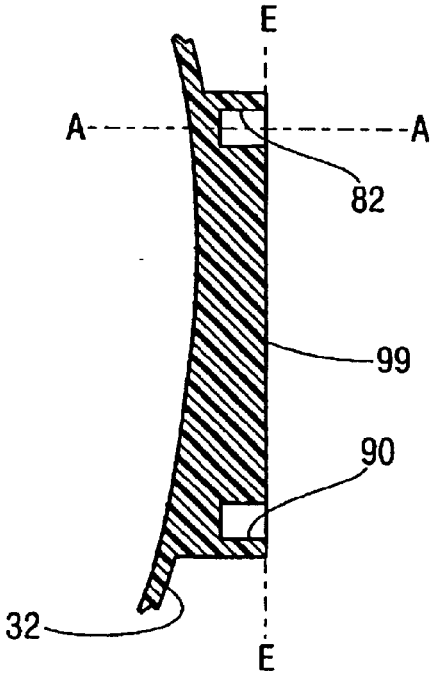
FIG. 5A is a partial cross-sectional view of the antenna of FIGS. 3A and 4A taken along line VA—VA in FIG. 4A.
Figure 4B:
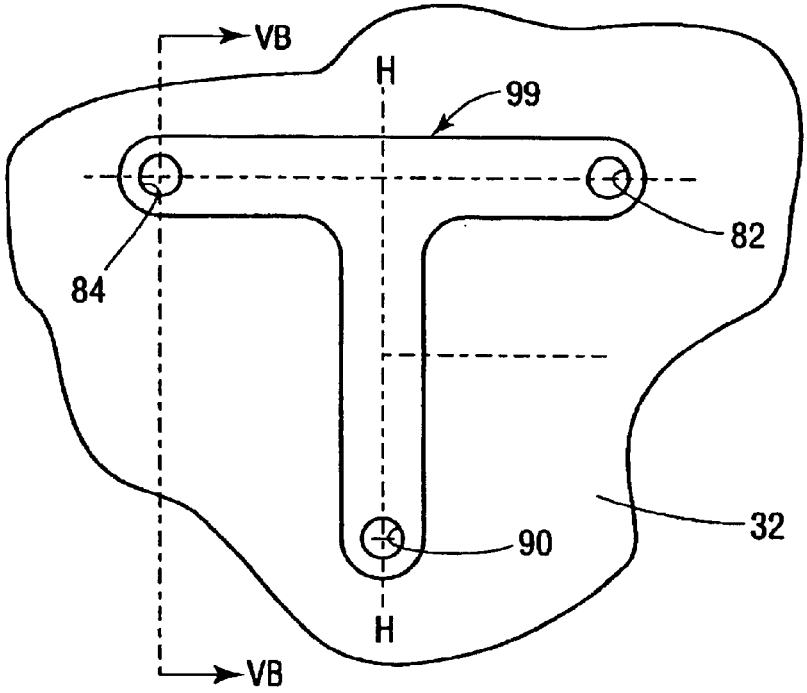
FIG. 4B is a partial view of another antenna with which an embodiment of the present invention may be employed.
Figure 5B:
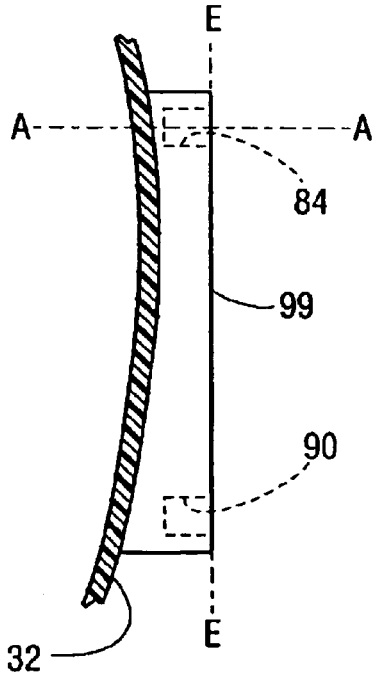
FIG. 5B is a partial cross-sectional view of the antenna of FIG. 4B taken along line VB—VB in FIG. 4B.

In this embodiment, the reflector 30 is molded from plastic utilizing conventional molding techniques. However, reflector 30 may be fabricated from a variety of other suitable materials such as, for example, stamped metal. The reflector 30 depicted in FIGS. 2 and 3 has a rear portion or surface 32 and a front surface 34. The support arm assembly is affixed to the lower perimeter of the reflector 30 by appropriate fasteners such as screws or like (not shown). As can be seen in FIGS. 4 and 5, the rear surface 32 is provided with three points (70, 72, 74) that define a plane, represented by line E—E, that is perpendicular or substantially perpendicular to the centerline axis A—A of the reflector (i.e., angle "F" is approximately 90 degrees). In this particular embodiment, point 70 is defined by a first socket 80 that is integrally molded or otherwise attached to the rear surface 32 of the reflector 30. Point 72 is defined by a second socket 84 that is integrally molded or otherwise attached to the rear surface 32 of the reflector 30. Similarly, point 74 is defined by a third socket 88 that is integrally molded or otherwise attached to the rear surface 32 of the reflector 30. In this embodiment, the first socket 80 has a first hole 82 therein, the second socket 84 has a second hole 86 therein and the third socket 88 has a third hole 90 therein. In an alternative embodiment as shown in FIGS. 3A, 4A, and 5A, the holes (82, 84, 90) are formed in a planar attachment portion 99 that is integrally formed with the rear surface 32 of the reflector 30. The planar attachment portion 99 serves to define the plane E—E that is substantially perpendicular to the centerline axis A—A of the reflector 30. In yet another alternative embodiment depicted in FIGS. 4B and 5B, the attachment portion 99 is attached to the rear surface 32 of the reflector 30 by a fastener medium such as adhesive, screws, etc. The purpose of the holes (82, 84, 90) will be discussed in further detail below.

Turning now to FIGS. 6–10, one embodiment of the antenna pointing apparatus 100 of the present invention includes a mounting base 110 and an instrument housing 130 that protrudes from the mounting base 110. The mounting base 110 may be fabricated from plastic or other suitable materials. Although the mounting base 110 is depicted in FIGS. 6–10 as having a relatively rectangular shape, those of ordinary skill in the art will appreciate that the mounting base 110 may be provided with other suitable shapes without departing from the spirit and scope of the present invention. Housing 130 may be fabricated from plastic or other suitable materials and may have one or more removable panels or portions to permit access to the components housed therein. In one embodiment, housing 130 supports a conventional digital compass 140 that has a digital display 142. Digital compasses are known in the art and, therefore, the manufacture and operation thereof will not be discussed in great detail herein. For example, a digital compass of the type used in conventional surveying apparatuses, including that apparatus manufactured by Bosch could be successfully employed. As will be discussed in further detail below, when the antenna pointing apparatus 100 is affixed to the antenna reflector 30, the digital compass 140 will display on its display 142 the azimuth setting for the centerline axis A—A of the reflector 30. Thus, the digital compass 140 and its digital display 142 form an azimuth meter for determining the azimuth of the reflector 30 when it is attached to the rear surface 32 of the reflector 30.

Figure 9:
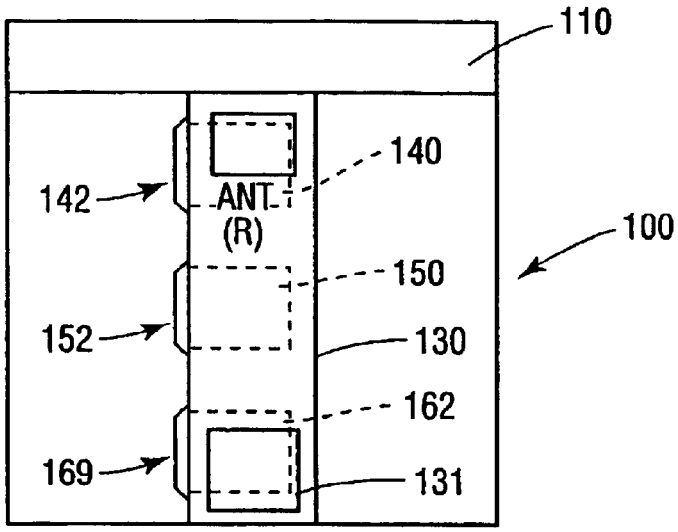
FIG. 9 is a top view of the antenna alignment apparatus of FIGS. 6–8.
Figure 10:
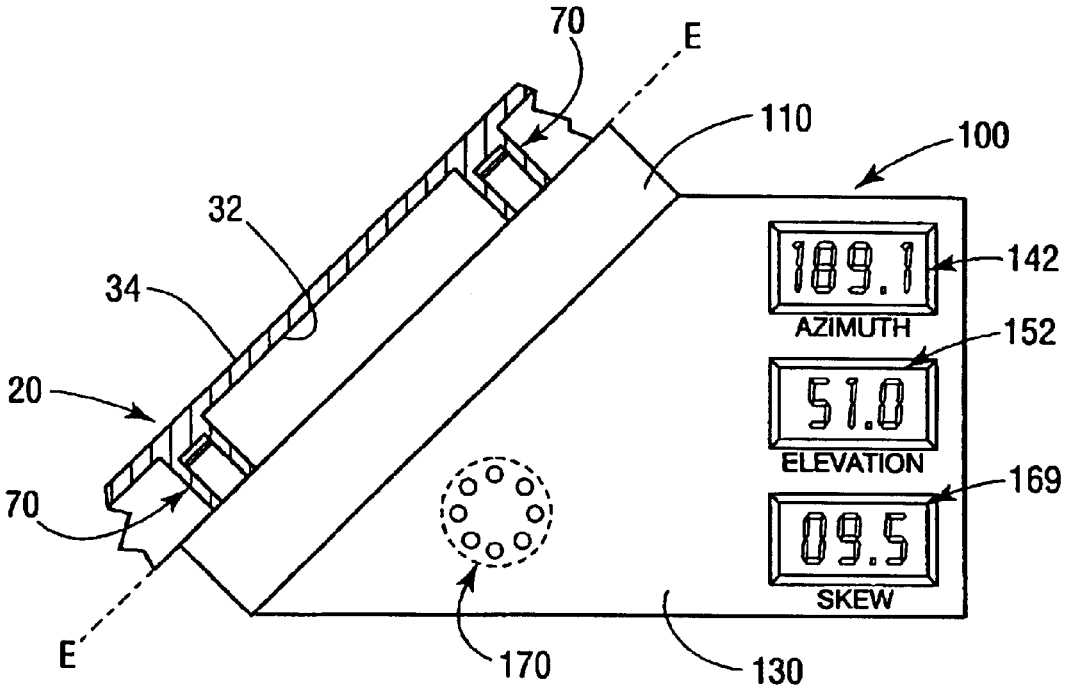
FIG. 10 is a side elevational view of the antenna alignment apparatus of FIGS. 6–9 attached to the rear surface of an antenna reflector with a portion of the antenna reflector shown in cross-section.

Also in this embodiment, a first digital level 150 which has a digital display 152 is supported in the housing member 130 as shown in FIGS. 9 and 10. Such digital levels are known in the art and, therefore, their construction and operation will not be discussed in great detail herein. For example, a digital level of the type used in conventional surveying apparatuses, including those manufactured by Bosch may be successfully employed. However, other digital levels may be used. Referring back to FIG. 3, the reflector 30 has a major axis A"—A" that extends along the longest dimension of the reflector 30. Major axis A"—A" is perpendicular to the centerline A—A. Similarly, the reflector 30 has a minor axis B"—B" that is perpendicular to major axis A"—A" and is also perpendicular to the centerline A—A. In this embodiment, the centerline of the first digital level is oriented such that it is received in a plane defined by the centerline axis A—A and the minor axis B"—B" when the device 100 is attached to the rear of the reflector 30.

Figure 9A:
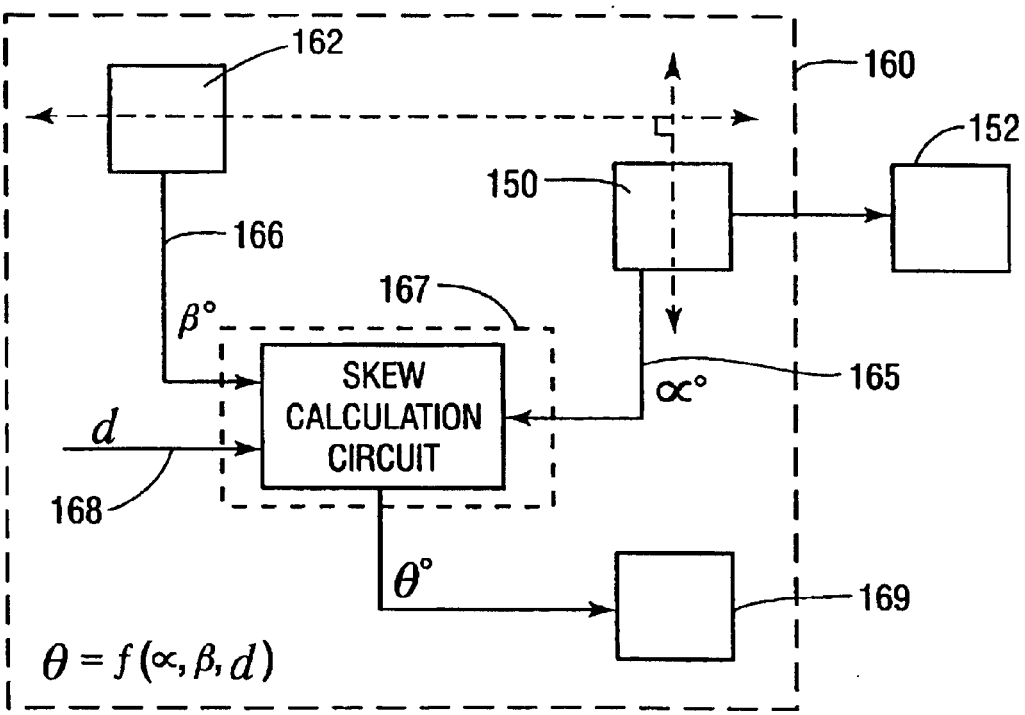
FIG. 9A is a schematic drawing of one control circuit arrangement that may be employed by one or more embodiments of the present invention to calculate the skew of the antenna to which it is attached.

This embodiment of the antenna-pointing device 100 also includes a skew meter generally designated as 160. The skew meter 160 includes a second digital level 162 of the type described above that is mounted perpendicular to the first digital level 152 (i.e., its centerline will be within the plane defined by the centerline axis A—A and the reflector's major axis A"—A" when the device 100 is attached to the reflector 30). See FIG. 9A. The output of the first digital level 150, which is designated as 165 (defining angle $\alpha$) and the output of the second digital level 162, which is designated as 166 (defining angle $\beta$), are sent to a conventional microprocessor 167. A calibration input, generally designated as 168 and defining distance "d" between a reference point on the device 100 and the centerline A—A of the reflector 30 is also sent to the microprocessor 167. Those of ordinary skill in the art will appreciate that the calibration input permits the installer to calibrate the device 100 for each individual reflector 30. Utilizing standard trigonometry calculations, the microprocessor 167 calculates the skew angle $\theta$0 of the reflector 30 and displays it on a digital skew meter display 169.

Figure 6:
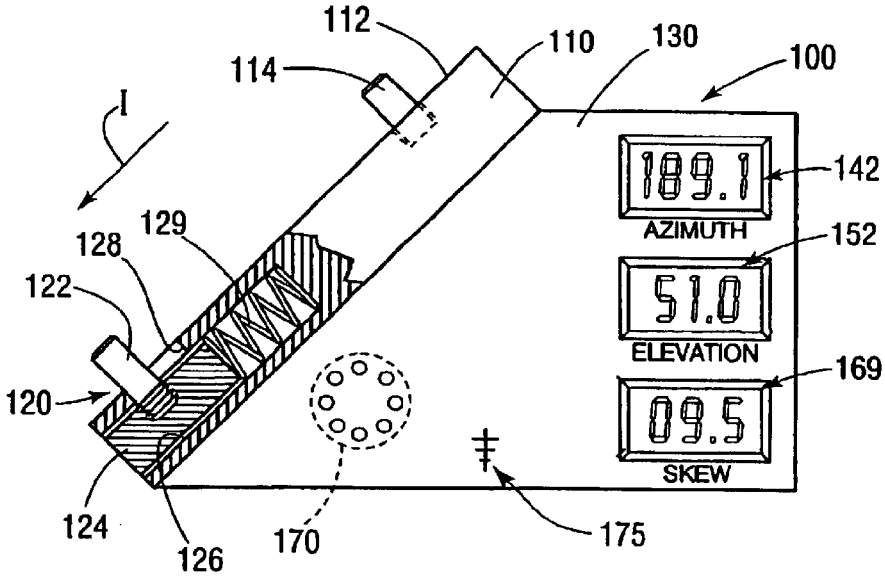
FIG. 6 is a side elevational view of one embodiment of an antenna alignment apparatus of the present invention showing a portion of the mounting member in cross-section.
Figure 8:
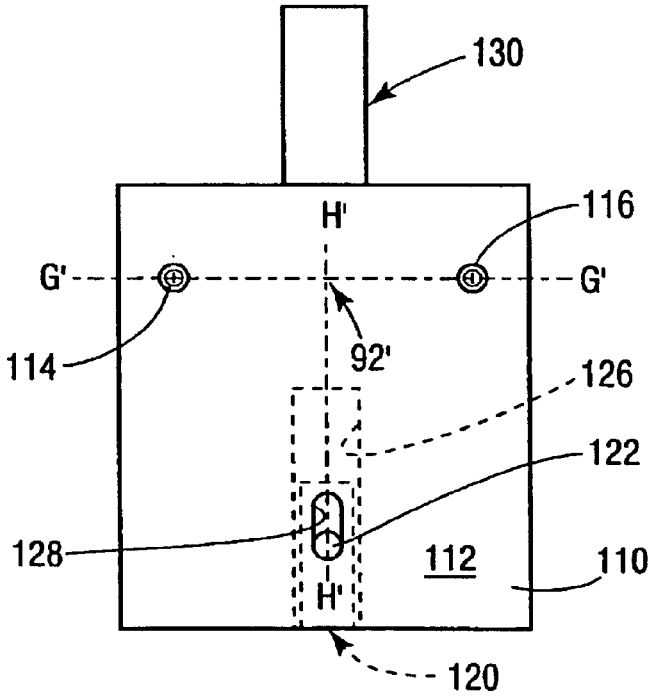
FIG. 8 is a rear view of the antenna alignment apparatus of FIGS. 6 and 7.

The mounting base 110 includes an attachment surface 112 that has a first pin 114 attached thereto that is sized to be inserted into the hole 82 in the first socket 80. A second pin 116 is attached to the mounting base 110 such that it is received in the second hole 86 in the second socket 84 when the first pin 114 is received in the hole 82 in the first socket 80. The centerlines of the first and second pins are located on a common axis G'—G'. See FIG. 8. A third movable pin assembly 120 is also provided in the mounting base 110 as shown in FIGS. 6 and 8. In this embodiment, the movable pin assembly 120 includes a pin 122 that is attached to a movable support member 124 that is slidably received within a hole 126 provided in the mounting base 110. The third pin 122 protrudes through a slot 128 in the mounting base 110 as shown in FIGS. 6 and 8. A biasing member in the form of a compression spring 129 is provided in the hole 126 and serves to bias the third pin 122 in the direction represented by arrow "I". The centerline H'—H' of the third movable pin 122 is perpendicular to and intersects axis G'—G' at point 92' as shown in FIG. 8.

To attach the mounting base 110 to the antenna reflector 30, the installer inserts the third pin 122 into the third hole 90 and applies a biasing force to the pointing device 100 until the first pin 114 may be inserted into the first hole 82 in first socket 80 and the second pin 116 may be inserted into the second hole 86 in the second socket 84. When pins (114, 116, and 122) have been inserted into their respective holes (82, 86, 90), the spring 129 applies a biasing force against the support member 110 that, in turn, biases the third pin 122 into frictional engagement with the inner surface of the third hole 90 in the third socket 88 to removably affix the pointing device 100 to the antenna reflector 30. When affixed to the reflector 30 in that manner (see FIG. 10), the distance "d" between point 92' and the point 92 through which centerline axis A—A of the antenna reflector 30 extends is input into the microprocessor 167 by a keypad or other standard input device to enable the microprocessor 167 to calculate and display the skew angle $\theta$ on the digital skew meter display 169. See FIG. 9A. In this embodiment, the digital compass 142 and the first and second digital levels 152 and 162, respectively are powered by a battery (not shown) supported in the housing 130. The battery may be rechargeable or comprise a replaceable battery or batteries. The housing 130 is provided with a battery access door 131 to permit the installation and replacement of batteries. However, it is conceivable that other compasses and digital levels that require alternating current may be employed.

Figure 10A:
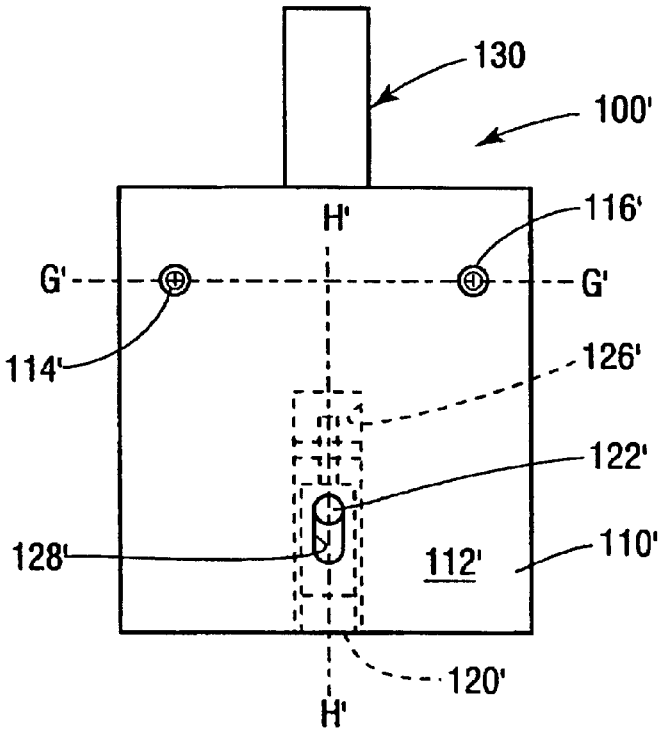
FIG. 10A is a rear view of another embodiment of the present invention.
Figure 10B:
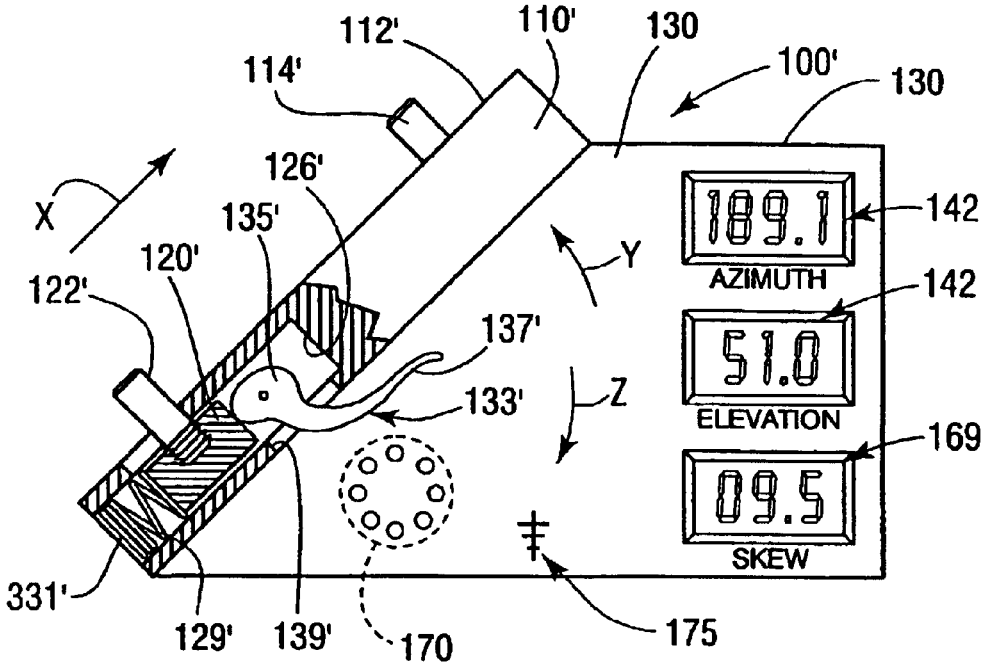
FIG. 10B is a side elevational view of the embodiment depicted in FIG. 10A.

An alternative method of attaching an embodiment of the antenna-pointing device 100' of the present invention is depicted in FIGS. 10A and 10B. The only difference in this embodiment, from the embodiment described above and depicted in FIGS. 6–10 is the method of attaching the mounting base 110' to the reflector 30. As can be seen in FIGS. 10A and 10B, the mounting base 110' includes an attachment surface 112' that has a first pin 114' attached thereto that is sized to be inserted into the hole 82 in the first socket 80. A second pin 116' is attached to the mounting base 110' such that it is received in the second hole 86 in the second socket 84 when the first pin 114' is received in the hole 82 in the first socket 80. The centerlines of the first and second pins are located on a common axis G'—G'. See FIG. 10A. A third movable pin assembly 120' is also provided in the mounting base 110'. In this embodiment, the movable pin assembly 120' includes a pin 122' that is attached to a movable support member 124' that is slidably received within a hole 126' provided in the mounting base 110'. The third pin 122' protrudes through a slot 128' in the mounting base 110' as shown in FIG. 10A and 10B. A biasing member in the form of a compression spring 129' is provided in the hole 126' and serves to bias the third pin 122' in the direction represented by arrow "X". The centerline H'—H' of the third movable pin 122' is perpendicular to and intersects axis G'—G' at point 92' as shown in FIG. 10A. To facilitate installation of the movable support assembly 120' and compression spring 129' within the hole 126', one end of the hole 126' may be threaded to receive a threaded cap 131'. See FIG. 10B. Also in this embodiment, a locking lever 133' that has a cam-shaped end 135' is pivotally pinned to the mounting base 110'. An actuation portion 137' protrudes through a slot 139' in the mounting base 110'.

To attach the mounting base 110' to the antenna reflector 30, the installer inserts the third pin 122' into the third hole 90 and applies a biasing force to the pointing device 100' until the first pin 114' may be inserted into the first hole 82 in first socket 80 and the second pin 116' may be inserted into the second hole 86 in the second socket 84. When pins (114', 116', and 122') have been inserted into their respective holes (82, 86, 90), the installer pivots the actuation portion 137' of the locking lever 133' in the direction represented by arrow "Y" in FIG. 10B to bias the pin 122' into frictional engagement with the inner surface of the third hole 90 in the third socket 88 to removably affix the pointing device 100' to the antenna reflector 30. To remove the device 100' from the reflector 30, the user simply pivots the actuation portion 137' in the direction represented by arrow "Z" in FIG. 10B. The antenna pointing device 100' is otherwise used in the same manner as described herein with respect to the antenna pointing device 100. The skilled artisan will further appreciate that other methods of attaching the antenna-pointing device 100 to the rear of the antenna reflector 30 may be employed without departing from the spirit and scope of the present invention.

The antenna-pointing device 100 may be employed to align the antenna's centerline axis A—A with the satellite as follows. After the antenna-mounting bracket 12 has been installed, the antenna 20 is affixed to the mounting bracket 12. In this embodiment, the mast portion 14 of the mounting bracket 12 is inserted into the socket 46 in the rear-mounting portion 44 of the arm assembly 40. The mast 14 is retained within the socket 46 by means of one or more setscrews 47 that extend through the rear-mounting portion 44 to engage the mast 14. See FIGS. 2 and 3. After the antenna has been preliminarily mounted to the mounting bracket 12, the antenna-pointing device 100 is snapped onto the rear of the antenna reflector 30 in the above-described manner. Because the antenna-pointing device 100 is affixed to the rear of the reflector 30, the installer's hands are free to adjust the antenna until it has been set at a desired azimuth, elevation and skew.

Upon attachment to the reflector, the digital display 142 will display the azimuth reading for the antenna's initial position. The installer then adjusts the antenna's position until the digital display 142 displays the desired azimuth reading. The antenna 20 is then locked in that position. The installer then observes the elevation reading displayed by the first digital compass display 152 and adjusts the position of the antenna until the elevation meter displays the desired reading and the antenna 20 is locked in that position. The setscrews 47 are loosened to permit the antenna to be rotated about the mast 14. The user then observes the skew meter display 169 and rotates the rearwardly extending portion 44 of the support arm 40 about the mast 14 until the skew meter display 169 displays the desired setting. Thereafter, the setscrews 47 are screwed into contact the support mast 14 to retain the antenna 20 in that position. The skilled artisan will appreciate that, because the centerline axis A—A is coaxially aligned with the centerline of the socket 46 in the support arm 40, the antenna 20 can be moved to the desired skew orientation by simply rotating the antenna reflector 30 about the mast 14. It will be further understood that the antenna pointing device 100 may also be used with other antennas that are mounted utilizing conventional mounting brackets and support apparatuses. The order of antenna adjustments described herein is illustrative only. Those of ordinary skill in the art will appreciate that the installer could, for example, set the skew first or the elevation first when orienting the antenna 20.

If the installer wishes to employ a set top box 60 to further optimize the antenna's alignment with the satellite 14, a coaxial cable 62 is attached to the feed/LNBF assembly 45 and the set top box 60. The antenna's position is further adjusted while monitoring the graphical display on the television 48 and the audio signal emitted by the set top box 60.

Another embodiment of the antenna pointing apparatus 100 of the present invention employs a speaker 170 that is supported on housing 130 and has a radio receiver antenna 175. This embodiment further includes a conventional transmitter 172 that is equipped with a conventional microphone 177. Transmitter 172 may be powered by batteries (not shown). Speaker 170 and transmitter 172 may be constructed of one way radio components like those sold as infant monitoring devices by Tandy Corporation and others or similar devices may be successfully employed. Those speakers 170 that employ a magnet should be mounted within the housing such that the magnet does not interfere with the operation of the digital or analog compass that may also be supported within the housing 130. Appropriate shielding means could also be employed.

Figure 6A:
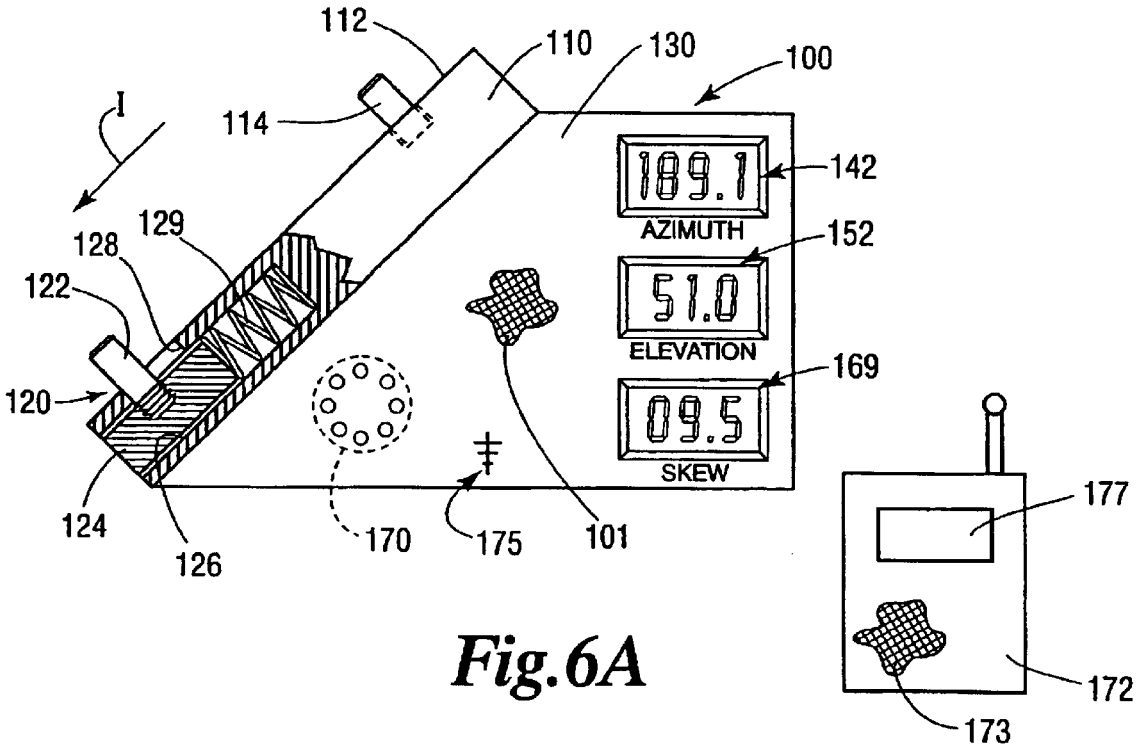
FIG. 6A is a side elevational view of another embodiment of an alignment apparatus of the present invention showing a portion of the mounting member in cross-section and a transmitter therefor.
Figure 7:
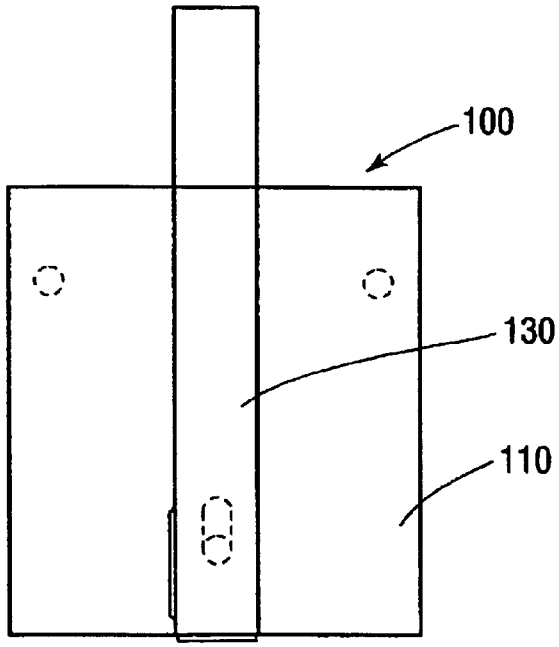
FIG. 7 is a bottom view of the antenna alignment apparatus of FIG. 6.

To use the speaker 170 and transmitter 172, the user places the transmitter 172 adjacent to the television's audio speaker 49 such that it can receive and transmit the audio signals emitted during use of the set top box 60 to the speaker 170. The antenna-pointing device 100 is attached to the rear of the antenna reflector 30 in the above-described manner and further positioning adjustments are made to the antenna 20 until the emitted audio signal indicates that the optimum orientation has been achieved. Those of ordinary skill in the art will appreciate that most set top boxes emit a repeating tone at a frequency that increases as the satellite signal improves until the series of tones becomes a single tone. The antenna 20 is then retained in that position by locking the appropriate adjustment screws on the mounting bracket. Those of ordinary skill in the art will readily appreciate that such arrangement permits an individual installer to employ the set top box to achieve optimum positioning of the reflector without having to make several trips between the antenna and the television. To make the transmitter easy to locate and thus prevent it from becoming misplaced or lost during installation, it may be provided in a bright color, such a florescent orange, red, yellow, etc. In addition, to enable the installer to quickly identify which transmitter 172 corresponds to a particular antenna alignment device 100, the alignment device may be provided with a first bright color 101, such as, for example, fluorescent orange, red, yellow, etc. and the transmitter 172 may be provided in a second color 173 that is identical to the first color 101. See FIG. 6A.

Figure 11:
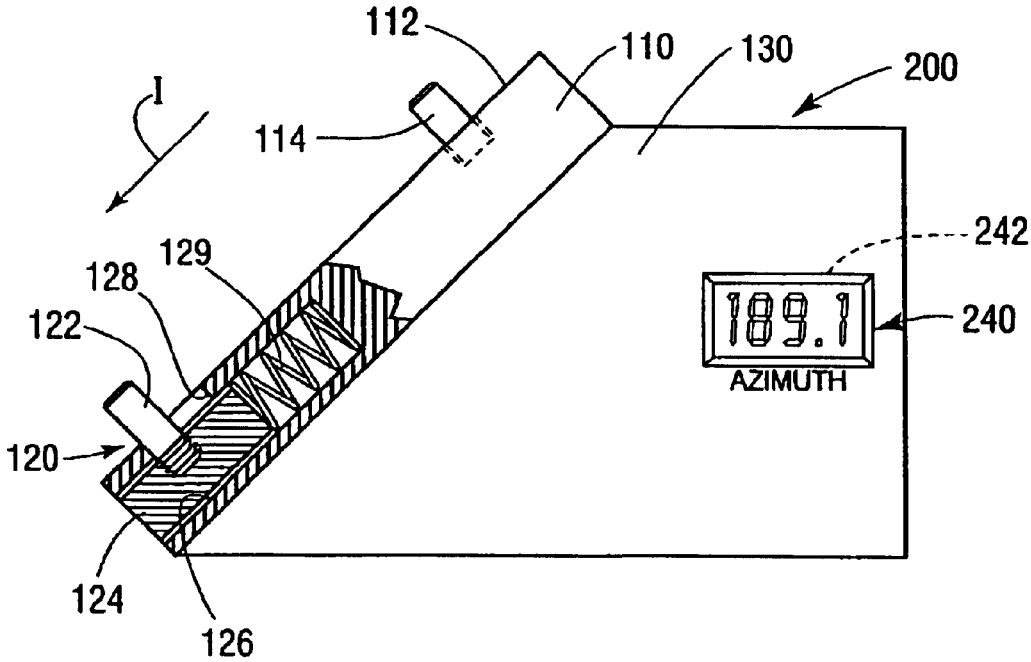
FIG. 11 is a side elevational view of another embodiment of an antenna alignment apparatus of the present invention showing a portion of the mounting member in cross-section.
Figure 12:
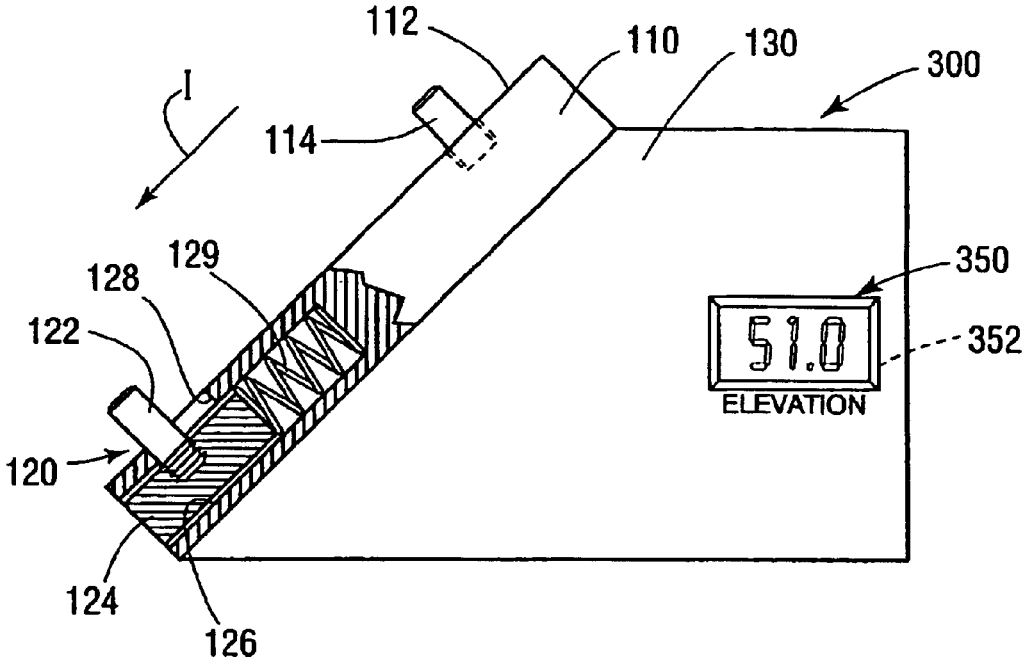
FIG. 12 is a side elevational view of another embodiment of an antenna alignment apparatus of the present invention showing a portion of the mounting member in cross-section.
Figure 13:
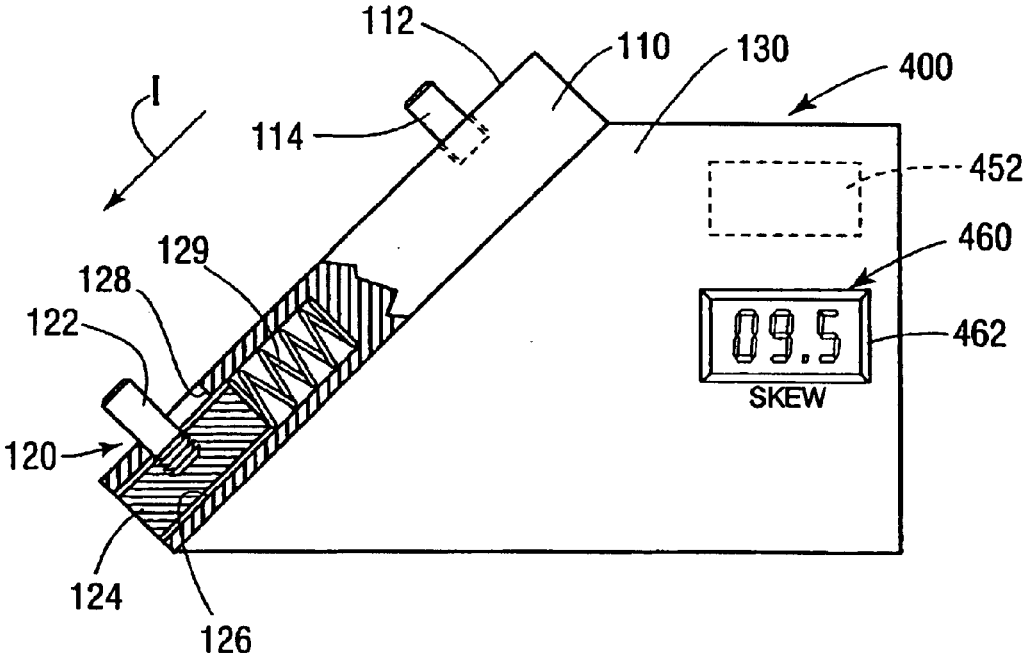
FIG. 13 is a side elevational view of another embodiment of an antenna alignment apparatus of the present invention showing a portion of the mounting member in cross-section.
Figure 14:
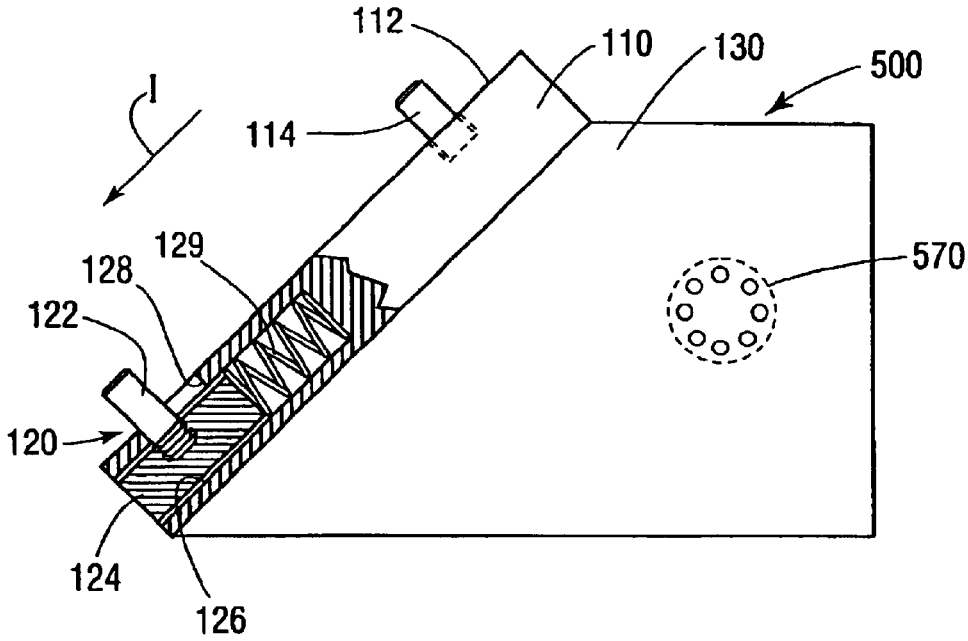
FIG. 14 is a side elevational view of another embodiment of an antenna alignment apparatus of the present invention showing a portion of the mounting member in cross-section.

The antenna alignment apparatuses of the present invention may comprise one or more of the following components: (i) digital compass, (ii) a first digital level, (iii) a second digital level, and/or (iv) a speaker. For example, as shown in FIG. 11, the antenna pointing device 200 is substantially identical to the antenna pointing devices described above, except that device 200 only includes an azimuth meter 240 that consists of a digital compass 242. The device 200 may be removably affixed to the rear surface 32 of the antenna reflector 30 in the manner described above. However, the device 200 will only provide an azimuth reading for the antenna 20. Similarly, as shown in FIG. 12, the antenna alignment device 300 is substantially identical to the antenna pointing devices 100 described above, except that the device 300 only includes an elevation meter 350 comprising one digital level 352. The device 300 may be removably affixed to the rear surface 32 of the antenna reflector 30 in the manner described above. However, the alignment device 300 will only provide an elevation reading for the antenna 20. The antenna alignment device 400 as shown in FIG. 13 has a skew meter 460 that displays a skew setting that is generated by two digital levels (152, 452) arranged perpendicular to each other and cooperate in the above-described manner to emit a display that is indicative of the skew of the antenna 20. The alignment device 400 is otherwise removably attachable to the antenna reflector 30, but it will only provide a skew reading for the antenna 20. The alignment device 500 illustrated in FIG. 14 is substantially identical to the antenna alignment device 100 described above, except that it is only equipped with the speaker 570. Thus, this alignment device 500 is removably attachable to the rear surface 32 of the antenna reflector 30 in the manner described above. However, alignment device 500 employs the speaker 570 to receive the tones emitted from the television speaker and transmitted by a transmitter 172 placed adjacent to the television speaker 49. The skilled artisan will appreciate that each of the above-described embodiments may be removably attached to the rear surface 32 of an antenna reflector 30 in a variety of other suitable manners.

Figure 15:
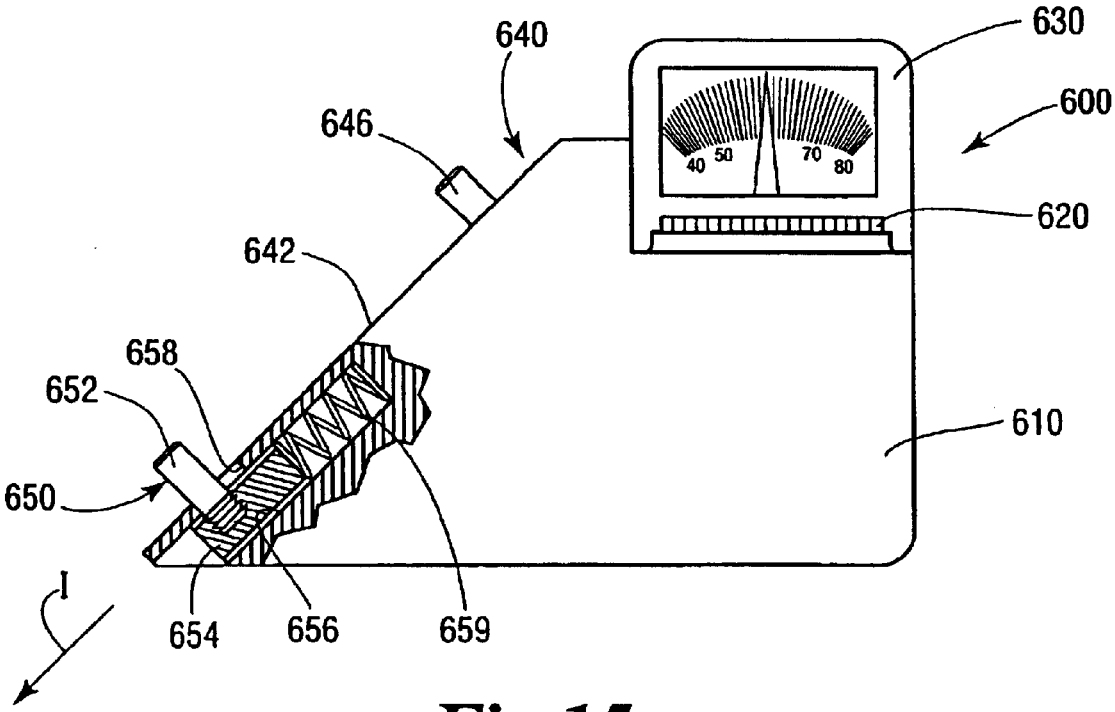
FIG. 15 is a side elevational view of another embodiment of the antenna alignment apparatus of the present invention with a portion thereof shown in cross section.
Figure 16:
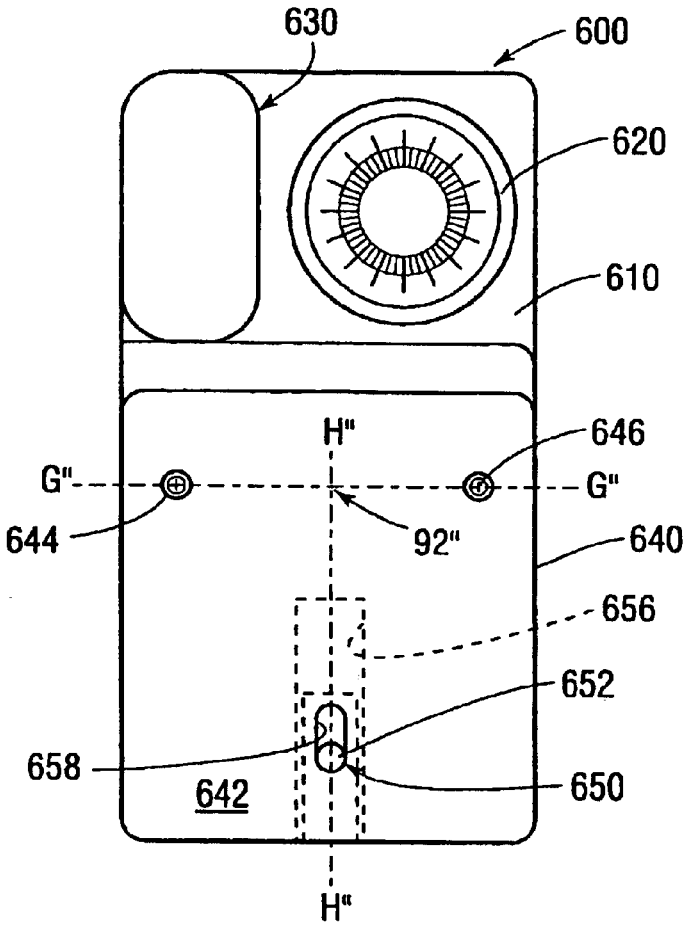
FIG. 16 is a top view of the antenna alignment apparatus depicted in FIG. 15.
Figure 16A:
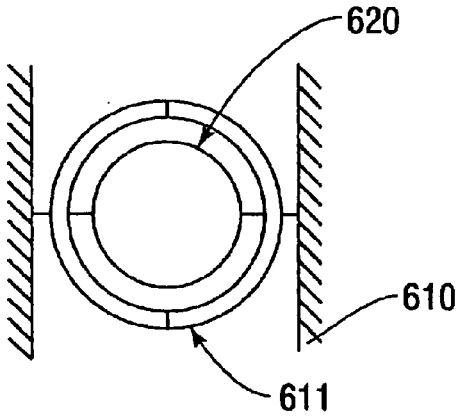
FIG. 16A is a diagrammatic view of the gimball mount arrangement for an analog compass employed in one or more embodiments of the present invention.
Figure 17:
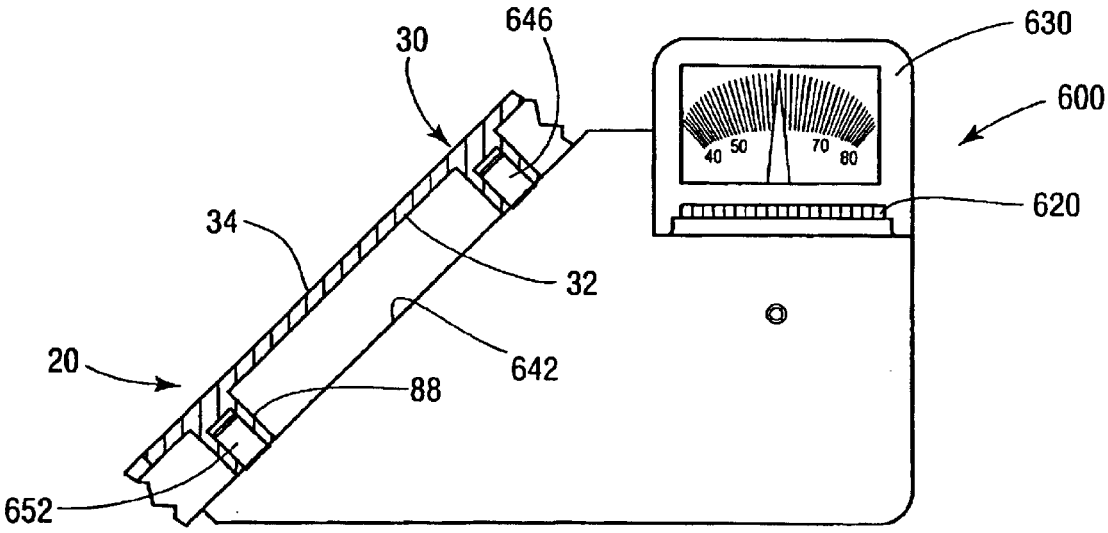
FIG. 17 is a side elevational view of the antenna alignment apparatus of FIGS. 15 and 16 attached to a rear portion of an antenna reflector with the portion of the reflector shown in cross-section.
Figure 18:
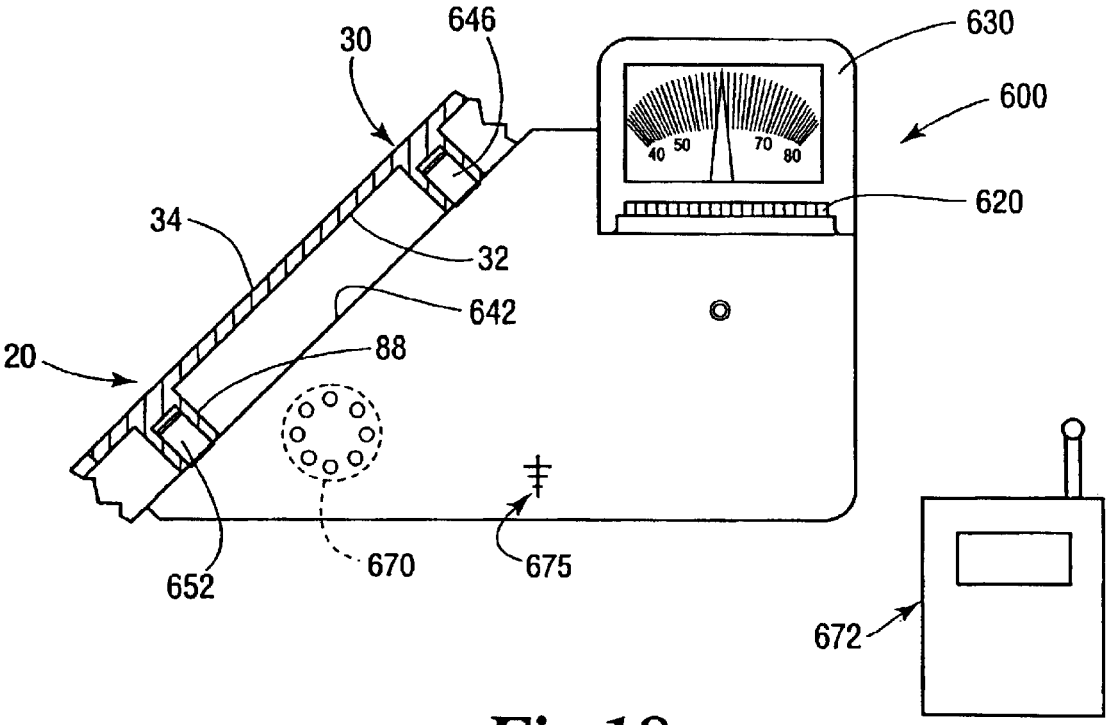
FIG. 18 is a side elevational view of another antenna alignment apparatus of the present invention.

FIGS. 15–17 illustrate another embodiment of the present invention. In that embodiment, the antenna pointing apparatus 600 includes a housing 610 that supports an analog compass 620 and an analog level 630 therein. Housing 610 maybe fabricated from plastic. However, housing 610 may be fabricated from a variety of other suitable materials. Compass 620 comprises any conventional analog compass such as, for example, those analog compasses employed in surveying apparatuses such as those manufactured by Bosch. The compass 620 is mounted in a conventional gimball mount 611 such that it remains level. The gimball mount 611 may be retained within the housing 610 by a frictional fit. See FIG. 16A. The level 630 may comprise any conventional analog level such as, those employed ion conventional surveying apparatuses. The analog level is mounted in housing 610 such that its centerline is within the plane defined by the reflector's centerline A—A and its minor axis B"—B".

The housing 610 further has an attachment portion 640 for attaching the antenna-pointing device 600 to the rear surface 32 of the antenna reflector 30. More particularly and with reference to FIGS. 6 and 9, the attachment portion 640 includes an attachment surface 642 that has a first pin 644 attached thereto that is sized to be inserted into the hole 82 in the first socket 80. A second pin 646 is attached to the attachment portion 640 such that it is received in the second hole 86 in the second socket 84 when the first pin 644 is received in the hole 82 in the first socket 80. The centerlines of the first and second pins (644, 646) are located on a common axis G"–G". See FIG. 16. A third movable pin assembly 650 is also provided in the attachment portion 640 as shown in FIGS. 15 and 16. In this embodiment, the movable pin assembly 650 includes a pin 652 that is attached to a movable support member 654 that is slidably received within a hole 656 provided in the attachment portion 640. The third pin 652 protrudes through a slot 658 in the attachment portion 640. A compression spring 659 is provided in the hole 656 and serves to bias the third pin 652 in the direction represented by arrow "I". The centerline H"—H" of the third movable pin 652 is perpendicular to and intersects axis G"—G" at point 92" as shown in FIG. 16.

To attach the attachment portion 640 to the antenna reflector 30, the installer inserts the third pin 652 into the third hole 90 and applies a biasing force to the pointing device 600 until the first pin 644 may be inserted into the first hole 82 in first socket 80 and the second pin 646 may be inserted into the second hole 86 in the second socket 84. When pins (644, 646 and 652) have been inserted into their respective holes (82, 86, 90), the spring 659 applies a biasing force against the movable support member 654 that, in turn, biases the third pin 652 into frictional engagement with the inner surface of the third hole 90 in the third socket 88 to removably affix the pointing device 200 to the antenna reflector 30. The skilled artisan will further appreciate that other methods of attaching the antenna-pointing device 600 to the rear portion of the antenna reflector 30 may be employed without departing from the spirit and scope of the present invention.

The antenna-pointing device 600 may be employed to align the antenna's centerline axis A—A with the satellite as follows. After the antenna-mounting bracket 12 has been installed, the antenna 20 is affixed to the mounting bracket 12. In this embodiment, the mast portion 14 of the mounting bracket 12 is inserted into the socket 46 in the rear-mounting portion 44 of the arm assembly 40. The mast 14 is retained within the socket 46 by means of one or more setscrews 47 that extend through the rear-mounting portion 44 to engage the mast 14. See FIGS. 2 and 3. After the antenna has been preliminarily mounted to the mounting bracket 12, the antenna-pointing device 200 is snapped onto the rear of the antenna reflector 30 in the above-described manner. Because the antenna-pointing device 600 is affixed to the rear of the reflector 30, the installer's hands are free to adjust the antenna until it has been set at a desired azimuth and elevation. Upon attachment to the reflector, the compass 620 will display the azimuth reading for the antenna's initial position. The installer then adjusts the antenna's position until the compass 620 displays the desired azimuth reading. The antenna is then locked in that position. The installer then observes the elevation reading displayed by the level 630 and adjusts the position of the antenna until the level 630 displays the desired reading and the antenna 20 is locked in that position. It will be understood that the antenna-pointing device 600 may also be used with other antennas that are mounted utilizing conventional mounting brackets and support apparatuses. The order of antenna adjustments described herein is illustrative only. Those of ordinary skill in the art will appreciate that the installer could, for example, set the elevation first when orienting the antenna 20.

If the installer wishes to employ a set top box 60 to further optimize the antenna's alignment with the satellite 14, a coaxial cable 62 is attached to the feed/LNBF assembly 45 and the set top box 60. The antenna's position is further adjusted while monitoring the graphical display on the television 48 and the audio signal emitted by the set top box.

Another embodiment of the antenna pointing apparatus 600 of the present invention employs a receiver and speaker 670 and a receiver antenna 675 that are supported in the housing 610. This embodiment further includes a conventional microphone and transmitter 672. Speaker 670 and transmitter 672 may comprise those commercially available speakers and transmitters that are often sold as infant monitoring devices or similar devices may be successfully employed. To use the speaker 670 and transmitter 672, the user places the transmitter 672 adjacent to the television's audio speaker 49 such that it can receive and transmit the audio signals emitted during use of the set top box 60 to the speaker 670. The antenna-pointing device 600 is attached to the rear of the antenna reflector 30 in the above-described manner and further positioning adjustments are made to the antenna until the emitted audio signal indicates that the optimum orientation has been achieved. Those of ordinary skill in the art will appreciate that most set top boxes emit a repeating tone at a frequency that increases as the satellite signal improves until the series of tones becomes a single tone. The antenna is then retained in that position by locking the appropriate adjustment screws on the mounting bracket. Those of ordinary skill in the art will readily appreciate that such arrangement permits an individual installer to employ the set top box to achieve optimum positioning of the reflector without having to make several trips between the antenna and the television.

Thus, from the foregoing discussion, it is apparent that the present invention solves many of the problems encountered by prior antenna alignment devices and methods. In particular, various embodiments of the present invention are easy to install and use. The present invention enables one installer to quickly and efficiently install and align an antenna with a satellite. Various embodiments of the present invention enable the installer to also use a set top box to optimize the antenna's orientation without making several trips between the antenna and the television to which the set top box is attached. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. An antenna alignment device for an antenna reflector having a rear portion, the alignment device comprising:

a digital compass removably supported on the rear portion of the reflector, a first digital level removably supported on the rear portion of the reflector; and a second digital level removably supported on the rear portion of the reflector and being oriented relative to said first digital level such that said second digital level is substantially perpendicular to said first digital level and wherein an out put from said first digital level and an output from said second digital level are transmitted to a microprocessor.

2. An antenna alignment device for an antenna reflector having a rear portion, the alignment device comprising:

a first digital level supported in a housing that is removably attachable to the rear portion of the reflector; and a second digital level supported by the rear portion of the reflector and being oriented such that said second digital level is substantially perpendicular to said first digital level and wherein an output of said first digital level and an output of said second digital level are transmitted to a microprocessor.

3. An antenna and alignment device therefor, comprising:

an antenna reflector having a rear surface;

a housing removably supported on said rear surface of said antenna reflector;

a digital compass supported within said housing;

a first digital level supported within said housing; and a second digital level supported in said housing and being oriented in said housing such that said second digital level is substantially perpendicular to said first digital level and wherein an output from said first digital level and an output from said second digital level are transmitted to a microprocessor.

4. An antenna alignment device for an antenna reflector having a rear portion, the alignment device comprising:

a digital compass directly attachable to the rear portion of the reflector; and a speaker supported by the rear surface of the reflector and a portable wireless transmitter for transmitting an audio signal generated by a television which is electrically communicating with the antenna to the speaker which is indicative of an alignment orientation of the antenna relative to a satellite.

5. An antenna and alignment device therefor, comprising:

an antenna reflector having a rear surface;

a housing directly attachable to the rear surface of the antenna reflector; and a digital compass supported within the housing; and a speaker supported in the housing and a portable wireless transmitter for transmitting an audio signal generated by a television which is electrically communicating with the antenna to the speaker which is indicative of an alignment orientation of the antenna relative to a satellite.

6. The antenna alignment device of claim 5 wherein the housing is provided in a first color and the transmitter is provided in a second color that is identical to the first color.

* * * * *